US009908345B2

(12) United States Patent
Beck et al.

(10) Patent No.: US 9,908,345 B2
(45) Date of Patent: Mar. 6, 2018

(54) MODULAR PRINT DRIVE ASSEMBLY AND PLATEN ASSEMBLY

(71) Applicant: ZIH CORP., Lincolnshire, IL (US)

(72) Inventors: David F. Beck, Exeter, RI (US); Richard J. Preliasco, North Kingstown, RI (US); Gregory R. Preliasco, Cumberland, RI (US); Matthew D. Corvese, Warwick, RI (US); Robert A. Hutnak, Douglas, MA (US); Anthony R. Helberg, Attleboro, MA (US); Roy P. Lyman, Coventry, RI (US); Christine M. Holden, Bellingham, MA (US)

(73) Assignee: ZIH Corp., Lincolnshire, IL (US)

( * ) Notice: Subject to any disclaimer, the term of this patent is extended or adjusted under 35 U.S.C. 154(b) by 0 days.

(21) Appl. No.: 15/287,096

(22) Filed: Oct. 6, 2016

(65) Prior Publication Data

US 2017/0021609 A1 Jan. 26, 2017

Related U.S. Application Data

(62) Division of application No. 14/622,162, filed on Feb. 13, 2015, now Pat. No. 9,493,017.

(51) Int. Cl.
*B41J 11/04* (2006.01)
*B41J 11/24* (2006.01)
(Continued)

(52) U.S. Cl.
CPC ..... *B41J 11/04* (2013.01); *B41F 3/54* (2013.01); *B41J 3/36* (2013.01); *B41J 11/14* (2013.01);
(Continued)

(58) Field of Classification Search
CPC ..... B41J 11/04; B41J 2/32; B41J 3/36; B41J 29/023
See application file for complete search history.

(56) References Cited

U.S. PATENT DOCUMENTS 5,791,796 A 8/1998 Gustavsson et al.
7,399,130 B2 7/2008 Hirte et al.
(Continued)

FOREIGN PATENT DOCUMENTS

EP 2353875 A1 10/2011

OTHER PUBLICATIONS

International Search Report and Written Opinion for International Patent Application No. PCT/US2016/013885 dated Aug. 26, 2016.

*Primary Examiner* — Kristal Feggins
*Assistant Examiner* — Kendrick Liu

(57) ABSTRACT

A modular print drive assembly and platen assembly are provided. The modular print drive assembly is structured for insertion and removal from a printer, the modular print drive assembly and includes a print drive housing defining a plurality of printer mount fasteners, a printhead coupled to and supported by the print drive housing, a platen latch assembly coupled to and supported by the print drive housing. The platen latch assembly is structured to removably receive a platen in position to define a nip between the platen and the printhead The modular print drive also includes a platen drive motor coupled to and supported by the print housing, wherein the platen drive motor is supported by the print housing in position to drive the platen upon receipt within the platen latch assembly.

9 Claims, 22 Drawing Sheets

(51) Int. Cl.

| | |
|---|---|
| ***B41J 15/04*** | (2006.01) |
| ***B41J 3/36*** | (2006.01) |
| ***B41J 11/14*** | (2006.01) |
| ***B41J 11/20*** | (2006.01) |
| ***B41F 3/54*** | (2006.01) |

(52) U.S. Cl.
CPC ..... *B41J 11/20* (2013.01); *B41J 11/24* (2013.01); *B41J 15/042* (2013.01)

(56) References Cited

U.S. PATENT DOCUMENTS

| | | | | |
|---|---|---|---|---|
| 8,979,407 | B2 | 3/2015 | Butzen et al. | |
| 2003/0118390 | A1 | 6/2003 | Yamada et al. | |
| 2004/0017434 | A1* | 1/2004 | Okayasu | B41J 2/355 347/56 |
| 2006/0014114 | A1 | 1/2006 | Groehl | |
| 2006/0024114 | A1 | 2/2006 | Lyman et al. | |
| 2006/0216098 | A1* | 9/2006 | Lyman | B41J 3/4075 400/613 |
| 2009/0219375 | A1 | 9/2009 | Trauer et al. | |
| 2010/0319561 | A1* | 12/2010 | Colquitt | B41J 2/325 101/477 |
| 2016/0052304 | A1* | 2/2016 | Obara | B41J 11/0095 347/220 |

* cited by examiner

MODULAR PRINT DRIVE ASSEMBLY AND PLATEN ASSEMBLY

RELATED APPLICATION

This patent arises from a divisional of U.S. patent application Ser. No. 14/622,162, filed Feb. 13, 2015, which is hereby incorporated herein by reference in its entirety.

FIELD

Embodiments discussed herein are related to mobile printers and, more particularly, a modular print drive assembly and platen assembly for use in mobile printers.

BACKGROUND

A number of deficiencies and problems associated with mobile printers are identified herein. Through applied effort, ingenuity, and innovation, exemplary solutions to many of these identified problems are embodied by the present invention, which is described in detail below.

BRIEF SUMMARY

A modular print drive assembly and modular platen assembly may be disclosed. In an embodiment, a platen latch assembly structured for moving between a latched position and an unlatched position is provided including a latch shaft defining a first end and a second end, a first latch arm and second latch arm each defining a latch hook opposite a pivot end, the first latch arm is coupled to the latch shaft proximate the pivot end of the first latch arm and the second latch arm is coupled to the latch shaft proximate the pivot end of the second latch arm, a latch release lever extending from the first latch arm between the latch hook and pivot end of the first latch arm, the latch release lever is structured to drive the platen latch assembly from the latched position to the unlatched position when actuated, and at least one latch arm weight extending proximate at least one of the pivot end of the first latch arm and the pivot end of the second latch arm.

In an example embodiment of the platen latch assembly the at least one latch arm weight includes a first latch arm weight and a second latch arm weight and the first latch arm weight extends proximate the pivot end of the first latch arm and the second latch arm weight extends proximate the pivot end of the second latch arm. In some example embodiments, the platen latch assembly also includes a return spring mount coupled to the latch shaft, the first latch arm, or second latch arm.

In some example embodiments of the platen assembly the first latch arm also includes at least one release projection, and the platen latch assembly also includes a second latch release lever including at least one release drive projection structured to engage the at least one release projection and drive the platen latch assembly from a latched to unlatched position when actuated. In an example embodiment, the platen latch assembly also includes a weight housing connected to the second end of the first latch arm. The at least one latch arm weight is retained in a weight housing. In some example embodiments of the platen latch assembly the first latch arm or second latch arm defines at least one weight reduction cavity between the latch hook and pivot end.

In another example embodiment, a platen assembly is provided including a platen housing defining a first platen shaft aperture proximate a first end a second platen shaft aperture proximate a second end, a platen structured to be rotatably received within the first platen shaft aperture and the second platen shaft aperture, and a substantially planar mounting flange extending from the platen housing that is structured to be slideably received by a printer lid assembly.

In an example embodiment the platen assembly also includes a platen housing defining a first platen shaft aperture proximate a first end a second platen shaft aperture proximate a second end, a platen structured to be rotatably received within the first platen shaft aperture and the second platen shaft aperture, the platen defining a drive end and a retention end and the platen also includes a first shaft bearing disposed proximate the drive end of the platen and within the first platen shaft aperture, a drive gear disposed proximate the drive end of the platen and further proximate the first shaft bearing, and a second shaft bearing disposed proximate the retention end of the platen and within the second platen shaft aperture.

In some example embodiments of the platen assembly, the platen comprises a platen shaft disposed within a platen roller, wherein the shaft has a retention end and drive end. In an example embodiment the platen assembly also includes a shaft journal connected to the retention end of the platen shaft. In an example embodiment of the platen, the platen shaft has a longitudinal axis, and wherein shaft journal is connected to the platen shaft at the same longitudinal axis as the platen shaft.

In an example embodiment of the platen assembly, the drive gear and shaft journal are removably connected to allow removal of the platen. In some example embodiments, the platen assembly also includes a tear bar connected to the platen housing configured to tear print media when pressure is applied to the print media against the tear bar. In an example embodiment of the platen assembly, the platen is a non-stick platen roller and the platen assembly further includes a platen scrapper. In an example embodiment of the platen assembly, the platen housing also includes a mounting flange and a plurality of mounting apertures, configured to align with a corresponding flange and a corresponding plurality of mounting apertures of a printer media access lid.

In a further example embodiment a platen latch assembly is provided including a latch arm defining a latch hook and a pivot end, wherein the latch arm is configured to rotate between a latched position and an unlatched position, a lock arm slideably coupled to translate along the latch arm between a locked and an unlocked position, and a cam actuator structured to drive the lock arm between the locked position and the unlocked position and further structured to drive the latch arm from the latched position to the unlatched position.

In an example embodiment of the platen latch assembly, the lock arm includes a lock bar at a lock end. In some example embodiments of the platen latch assembly, the lock arm includes at least one lock arm aperture and the latch arm comprises at least one lock guide, and the at least one lock guide penetrate the at least one lock arm aperture. In some example embodiments of the platen latch assembly, the alignment of the platen latch assembly is maintained in response to the at least one lock guide penetration of the at least one lock arm aperture.

In an example embodiment of the platen latch assembly, the lock arm includes a tension mount at a tension end and the latch arm also includes a tension mount disposed between the latch hook and the pivot end. In some example embodiments, the platen latch also includes a tension mechanism connected between the tension mount of the latch arm and the tension mount of the lock arm and the lock arm is biased toward the locked position in response to the tension mechanism application of tension between the tension mount of the latch arm and the tension mount of the lock arm.

In an example embodiment, platen latch assembly also includes a lock cam connected to the lock arm. The lock arm moves to the unlocked position in response to operation of the lock cam. The platen latch assembly also includes a latch cam connected to the latch arm. The latch arm moves to the unlatched position in response to operation of the latch cam. In some example embodiments of the platen latch assembly, the latch hook of the latch arm is disengaged from a platen assembly in response to operation of the latch cam.

In some example embodiments of the platen assembly, the cam actuator is configured to operate the locking cam prior to operating the latch cam when actuated. In an example embodiment of the platen assembly, actuation of the cam actuator includes rotation of the cam actuator. In an example embodiment of the platen assembly, the cam actuator also includes a lock operating projection configured to operate the lock cam and a latch operating projection configured to operate the latch cam. In some example embodiments of the platen assembly, the platen latch assembly also includes a latch release configured to actuate the cam actuator.

In an example embodiment of the platen latch assembly, the pivot is a shaft receiver and the platen latch assembly also includes a shaft connected to the shaft receiver at a first end and a second latch arm at a second end. In some example embodiments of the platen latch assembly, the latch arm or lock arm define at least one weight saving cavity. In an example embodiment of the platen latch assembly, the cam actuator is a rack and pinion.

In yet a further example embodiment, a modular print drive assembly structured for insertion and removal from a printer, the modular print drive assembly is provided including a print drive housing defining a plurality of printer mount fasteners, a printhead coupled to and supported by the print drive housing, a platen latch assembly coupled to and supported by the print drive housing. The platen latch assembly is structured to removably receive a platen in position to define a nip between the platen and the printhead. The modular print drive assembly also includes a platen drive motor coupled to and supported by the print housing, wherein the platen drive motor is supported by the print housing in position to drive the platen upon receipt within the platen latch assembly.

In some example embodiments of the modular print drive assembly, the print mount fasteners comprise a plurality of print mount retention apertures defined by the print drive housing and a plurality of retaining mechanisms. In an example embodiment, the print drive assembly also includes a print drive tear bar connected to the printhead housing configured to tear a print media when in a first direction. In an example embodiment of the print drive assembly, the platen latch is configured to retain the platen of a platen assembly against a printhead, wherein the platen assembly also includes a platen tear bar configured to tear a print media in a second direction opposite the first direction. In some example embodiments of the print drive assembly, the platen latch assembly includes a first latch release lever and second latch release lever configured to release a platen latch, wherein the first platen release lever is configured to be operated in a first direction and the second latch release lever is configured to be operated in a second direction opposite of the first direction.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein;

Figure 10A:
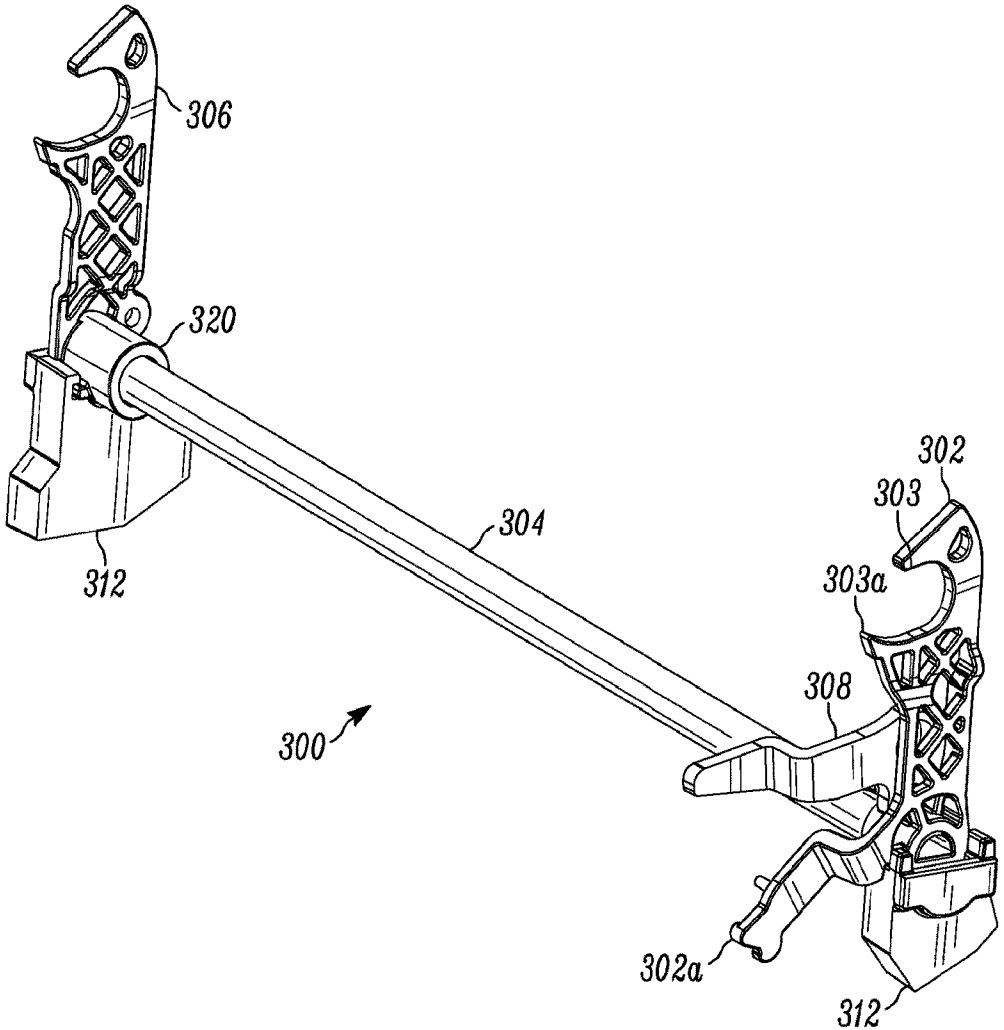
FIG. 10A illustrates a perspective view of an assembled exemplary weighted latch assembly in accordance with an example embodiment of the present invention.
Figure 10C:
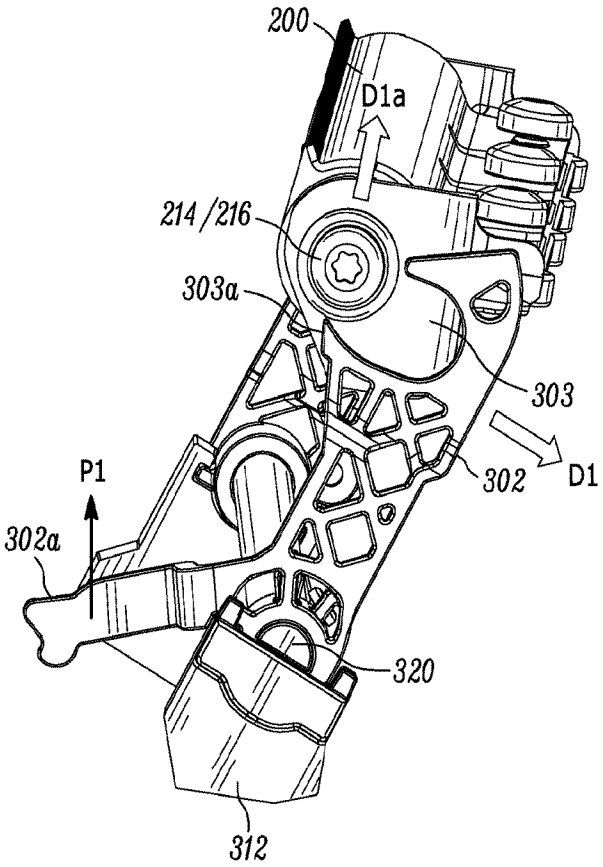
Figure 10B:
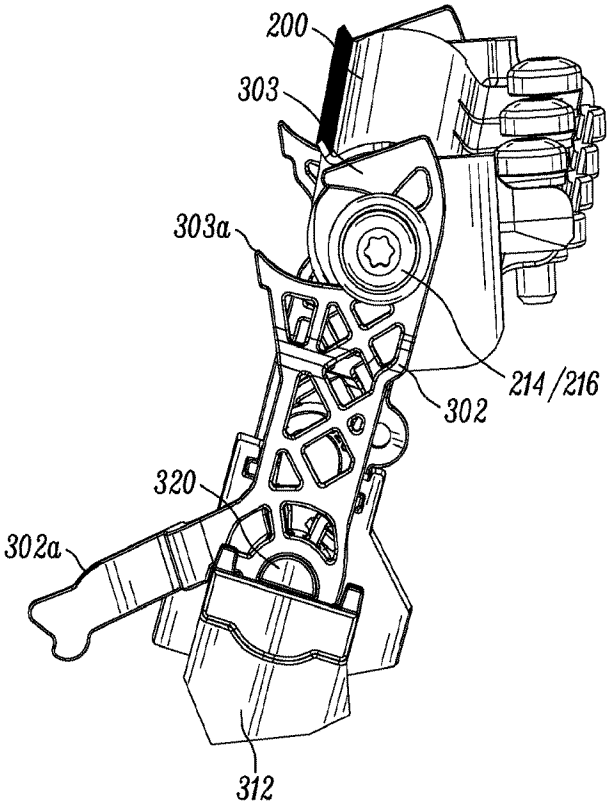
Figure 10D:
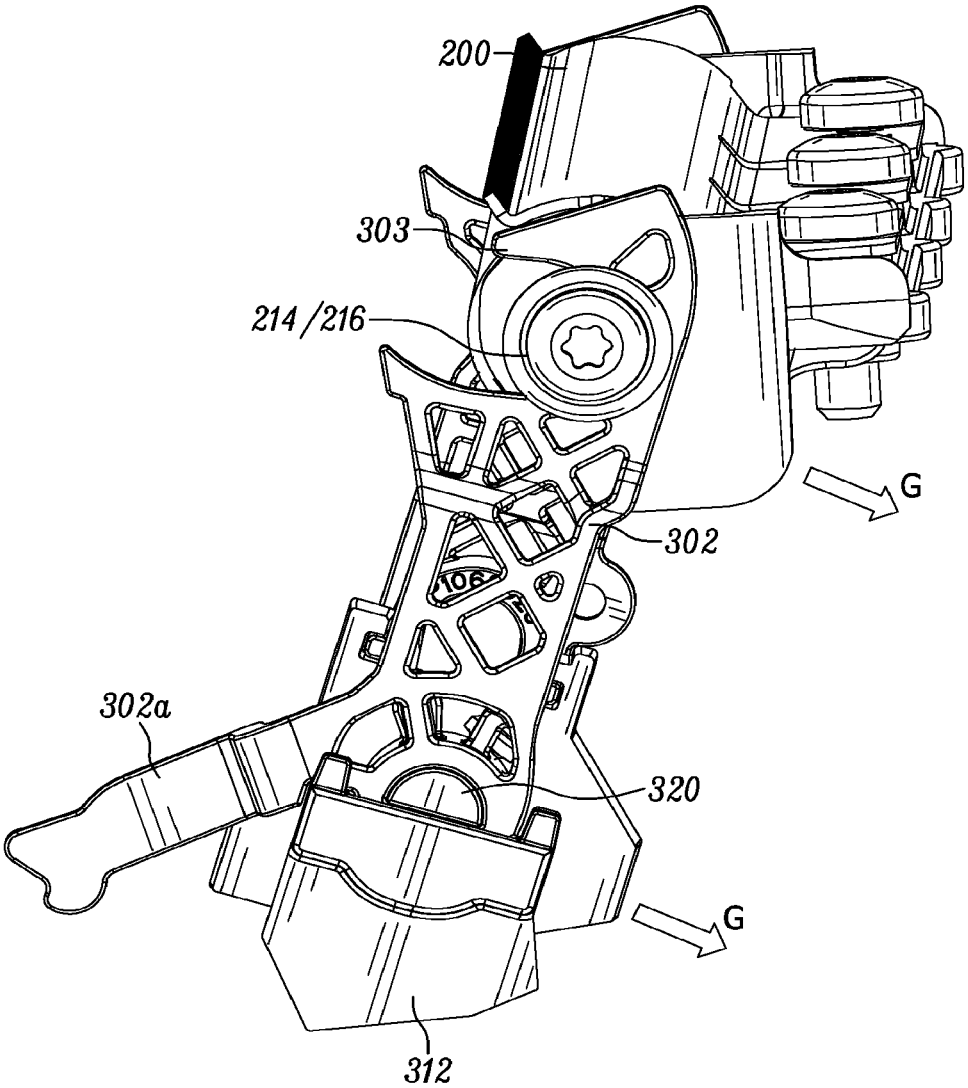
Figure 11A:
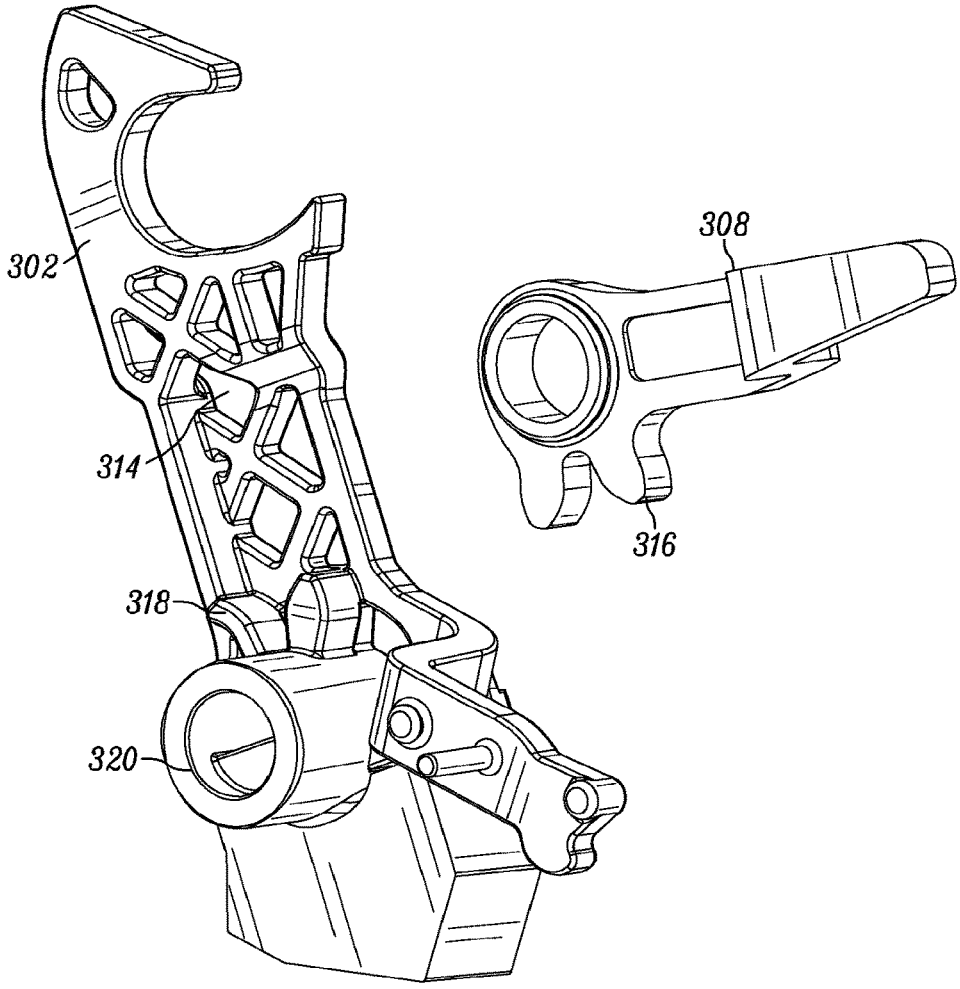
Figure 11B:
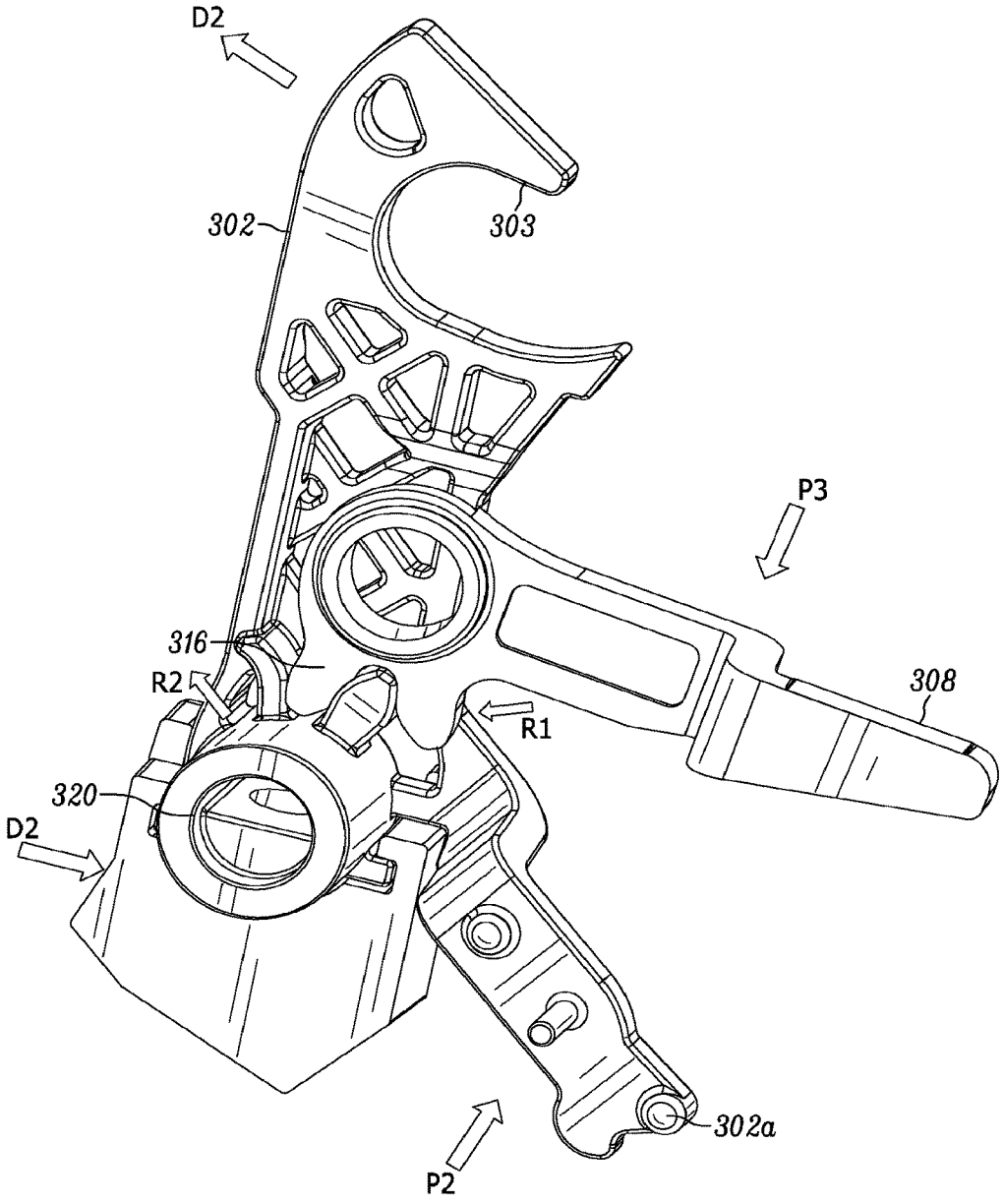
Figure 12:
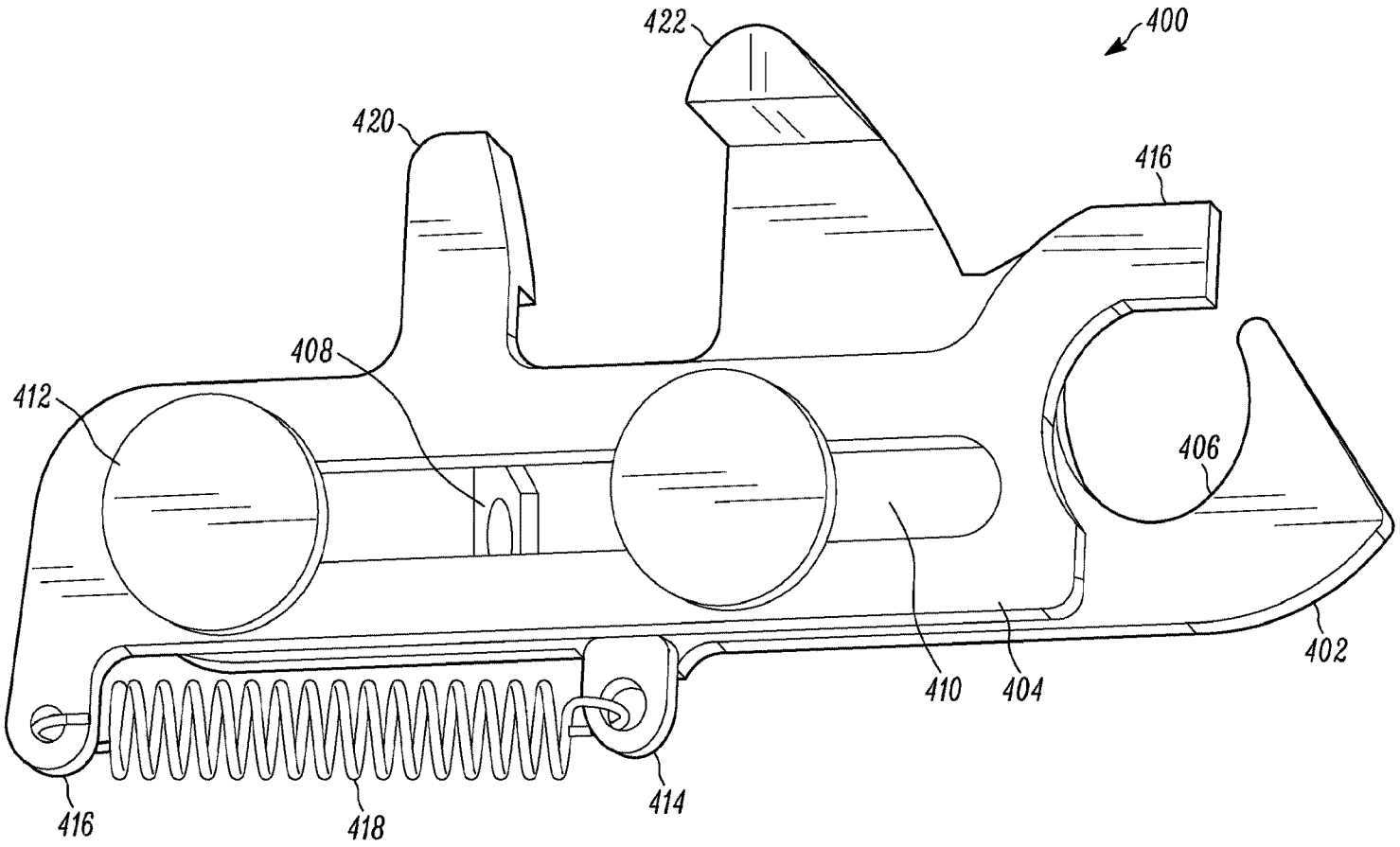
Figure 13A:
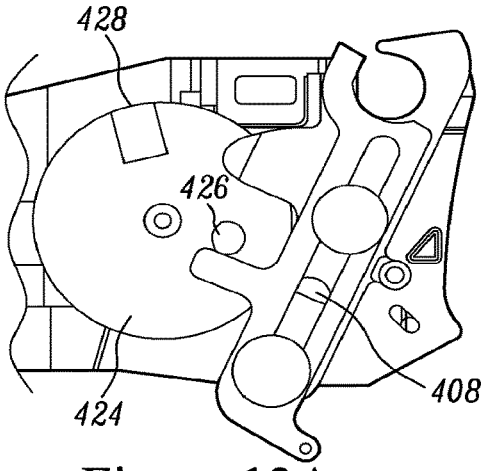
Figure 13B:
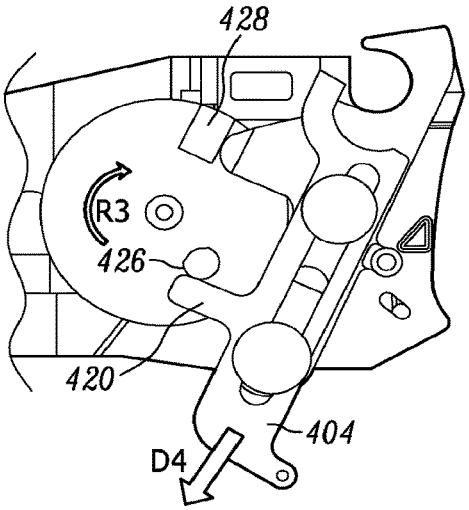
Figure 13C:
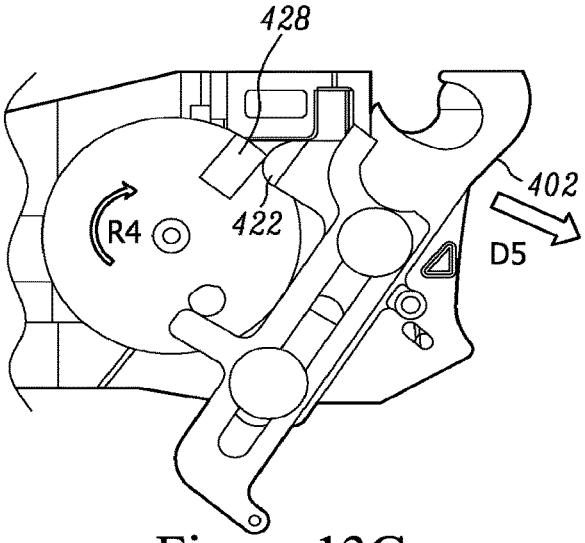
Figure 13D:
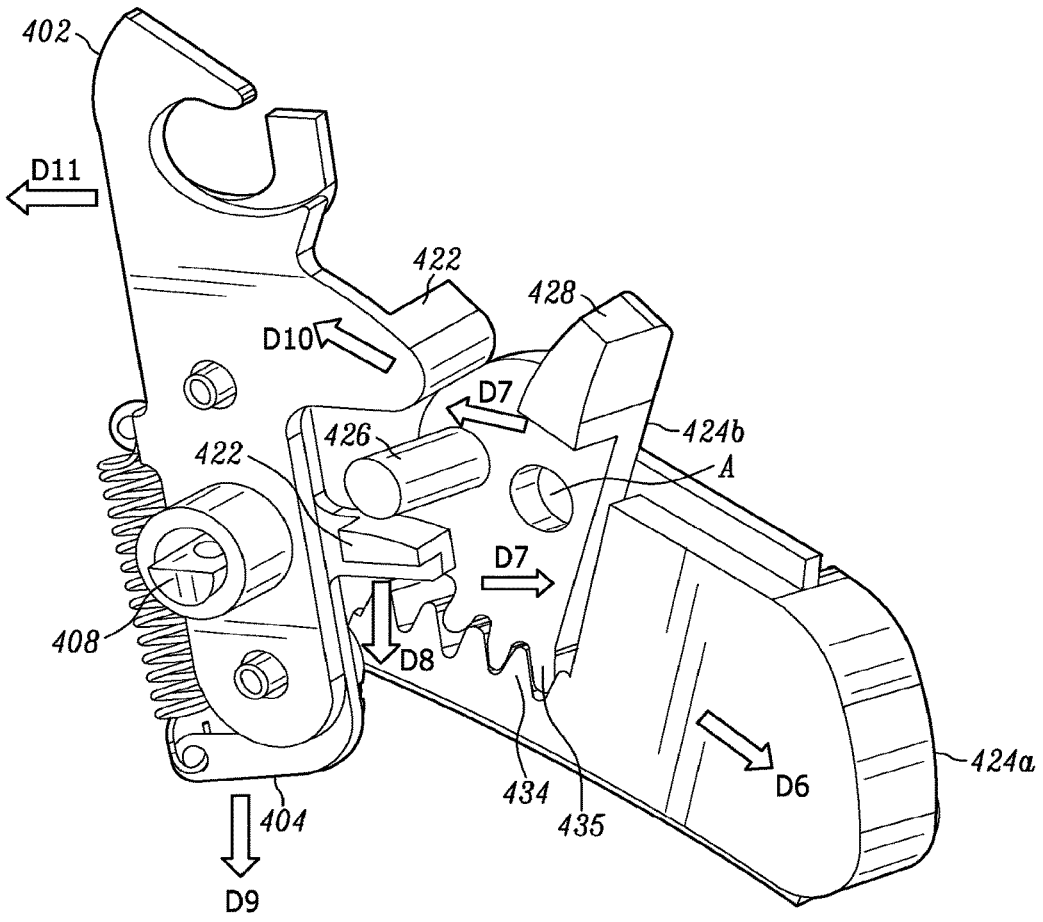
Figure 14A:
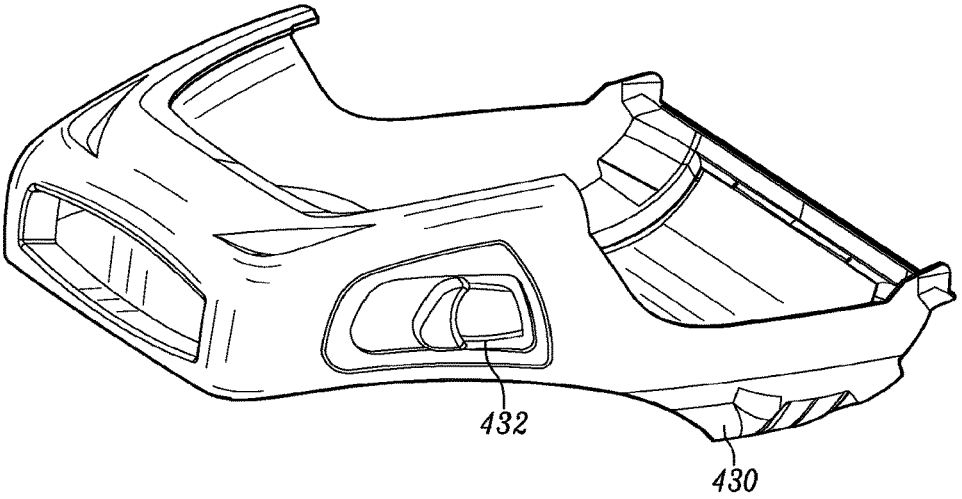
Figure 14B:
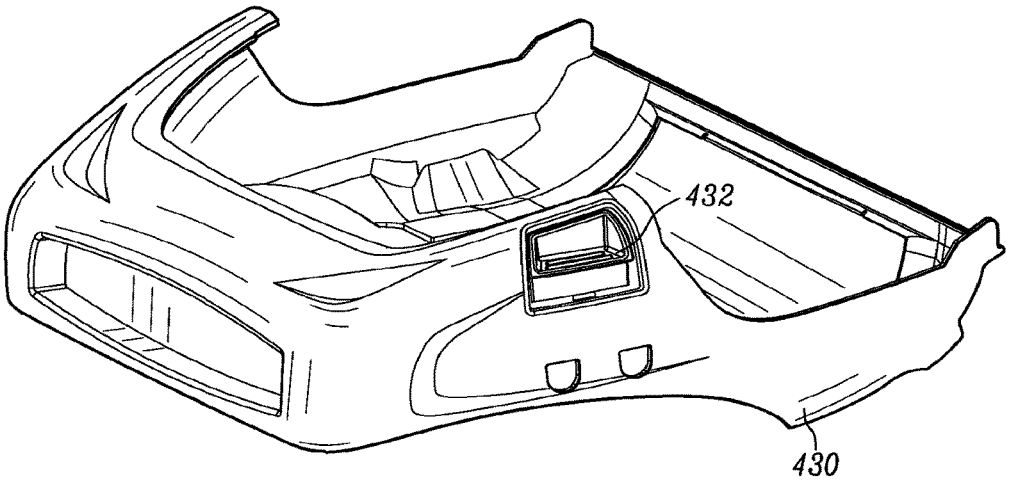

FIGS. 10B-D illustrate perspective views and operations of an assembled exemplary weighted latch assembly in accordance with an example embodiment of the present invention;

FIG. 11A illustrates an exploded view of the latch arm and the second release lever in accordance with an example embodiment of the present invention;

FIG. 11B illustrates a perspective view and operations of the latch arm and the second release lever in accordance with an example embodiment of the present invention FIG. 12 illustrates a front perspective view of a locking platen latch assembly in accordance with some example embodiments of the present invention;

FIGS. 13A-C illustrate a front perspective view and operation of a locking platen latch assembly in accordance with some example embodiments of the present invention;

FIG. 13D illustrates a rear perspective view and operation of a locking platen latch assembly in accordance with some example embodiments of the present invention; and FIGS. 14A and 14B illustrate an example platen latch release buttons in accordance with an example embodiment of the present invention.

DETAILED DESCRIPTION

The present invention now will be described more fully hereinafter with reference to the accompanying drawings, in which some, but not all embodiments of the inventions are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Overview

Conventional mobile printers may require significant disassembly to replace or repair components such as the print drive and/or the platen. The disassembly of the printer may necessitate the removal of several small pieces and fasteners which may be difficult to remove and/or replace. In some instances the fasteners may be small and easy to lose during a repair or replacement of the printer components.

Utilizing modular components such as the modular platen assembly or modular print drive, discussed herein, may reduce the time and energy needed to perform replacements. Further, reduction in the disassembly may also reduce missing parts during reassembly. The modular component replacement may cause mobile printers to be returned to service faster and with greater reliability.

Various embodiments of the present invention may be directed to a platen latch assembly that is configured to better secure a platen (and media door) in response to printer impacts and other events that might otherwise serve to unlatch the platen (and media door). In some embodiments, the platen latch assembly may be made more reliable by adding a biasing weight to latch assembly. The biasing weight may be configured to counter the unlatching force of an impact based on the geometry of the biasing weight being affixed to a latch arm opposite the latch pivot. The biasing weight may cause a force opposite the latch arm that operates to assist the latch return spring in maintaining the platen latch and the media lid closed.

The platen latch assembly may, additionally or alternatively, be configured with a latch lock to increase latch reliability. The platen latch assembly may be configured as a two-step, e.g., locking latch, in which the actuation of a latch release may first unlock the latch and then move the latch arm to an unlatched position. In some embodiments, the two step latch assembly may prevent the platen assembly from inadvertently disengaging from the printhead and/or the media lid from opening thereby protecting the expensive media from damage.

Example Modular Print Drive and Platen Assemblies

Figure 1A:
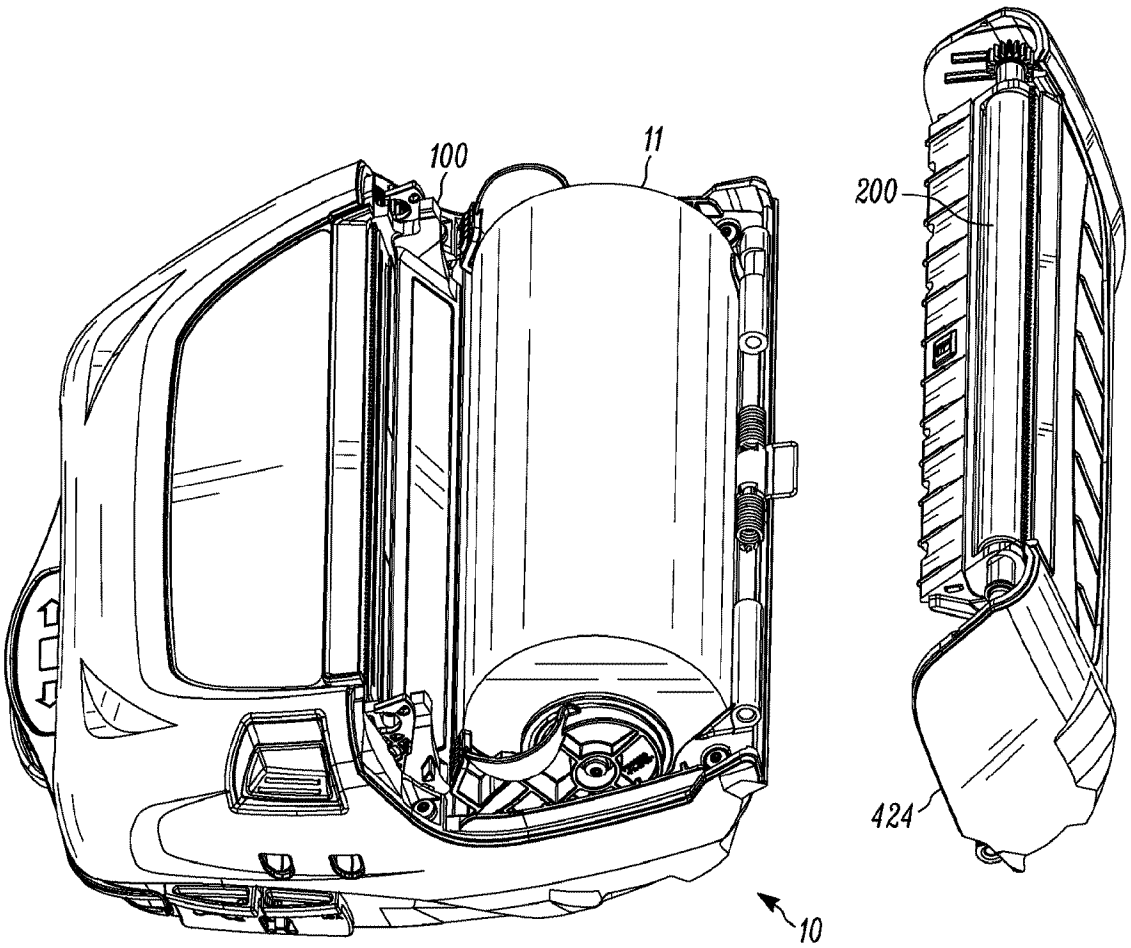
FIG. 1A illustrates a perspective view of an exemplary mobile printer according to an example embodiment of the present invention.

FIG. 1A illustrates a perspective view of an exemplary mobile printer 10 according to an example embodiment of the present invention. The mobile printer may include a modular printer assembly 100, a modular platen assembly 200, a media lid 424, and media 11. The media lid 424 is open and removed from the printer 10.

Figure 1B:
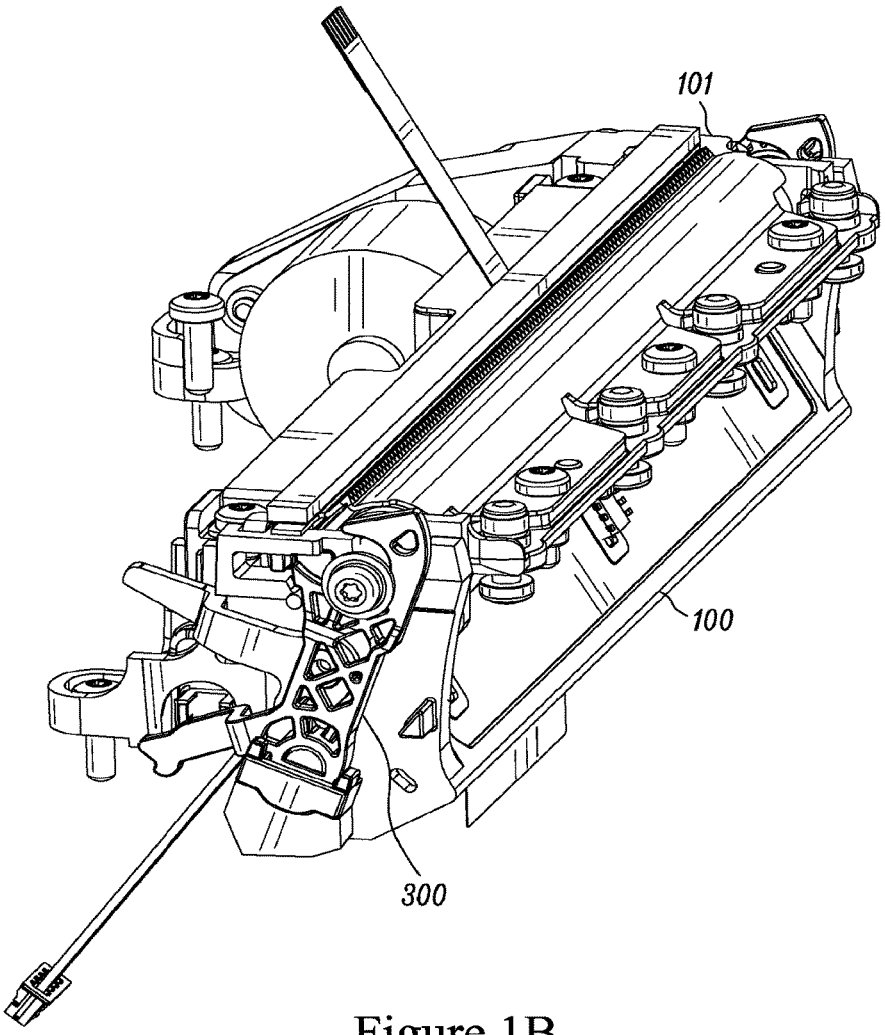
FIG. 1B illustrates a perspective view of exemplary modular print drive and platen assemblies according to an example embodiment of the present invention.

FIG. 1B illustrates a perspective view of exemplary modular print drive 100 and platen 200 assemblies according to an example embodiment of the present invention. The modular print drive 100 and platen assemblies 200 may include a print drive assembly 100 and platen assembly 200. The platen assembly 200 may be held in position against a printhead of the print drive assembly by the latch assembly 300.

Figure 1C:
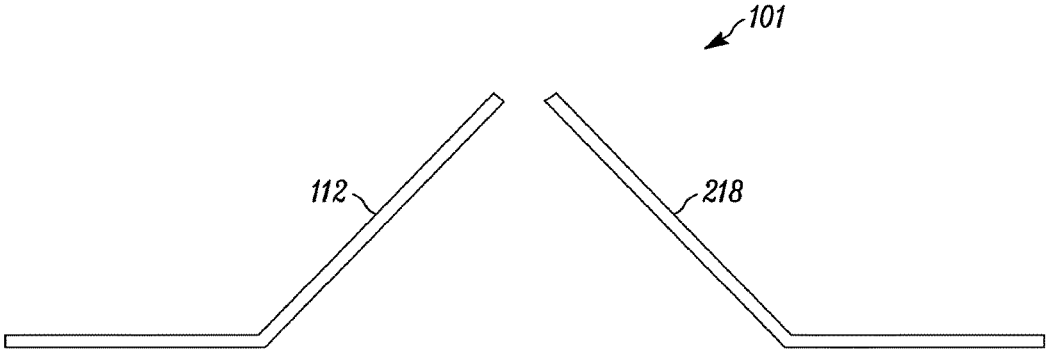
FIG. 1C illustrates a cross-sectional view of the dual tear bar according to an example embodiment of the present invention.

In an instance in which the platen assembly 200 is engaged with the print drive assembly 100, the respective tear bars (112 and 218 discussed below) may be aligned to create a dual tear bar 101. The respective tear bars 112 and 218 may have a sharp edge, teeth, serration, or the like configured to tear the printed media at or near the contact point of the media and the dual tear bar 101. The tear bars 112/218 may tear the media when pressure is applied to the media against the tear bar. In an instance in which a mobile printer is equipped with a dual tear bar 101, the media may be torn by the platen tear bar 218 when pressure is applied to the media against the platen tear bar, or by the print drive tear bar 112 when pressure is applied to the media against the print drive tear bar 112. In other words, tear bars 112/218 are structured such that the media may be torn by applying pressure in either direction. Specifically, the printed media may pass through the dual tear bar 101, e.g. the print drive tear bar 112 is on a first side of the printed media and the platen assembly tear bar 218 is on the second side of the printed media. In some embodiments, the tear bars 112/218 may create a funnel shape, based on the angle of the tear bars. The funnel shape may be wider on the printer side of the tear bars 112/218 which receives the media and narrower at a media output side, as depicted in FIG. 1C.

The print drive assembly 100, platen latch assembly 300 and platen assembly 200 are discussed in further detail below. The print drive assembly 100 is discussed in FIGS. 2-5, the platen assembly 200 is discussed in FIG. 6-8C, and platen latch assemblies 300 and 400 are discussed in FIGS. 9-14C.

Example Modular Print Drive Assembly

Figure 2A:
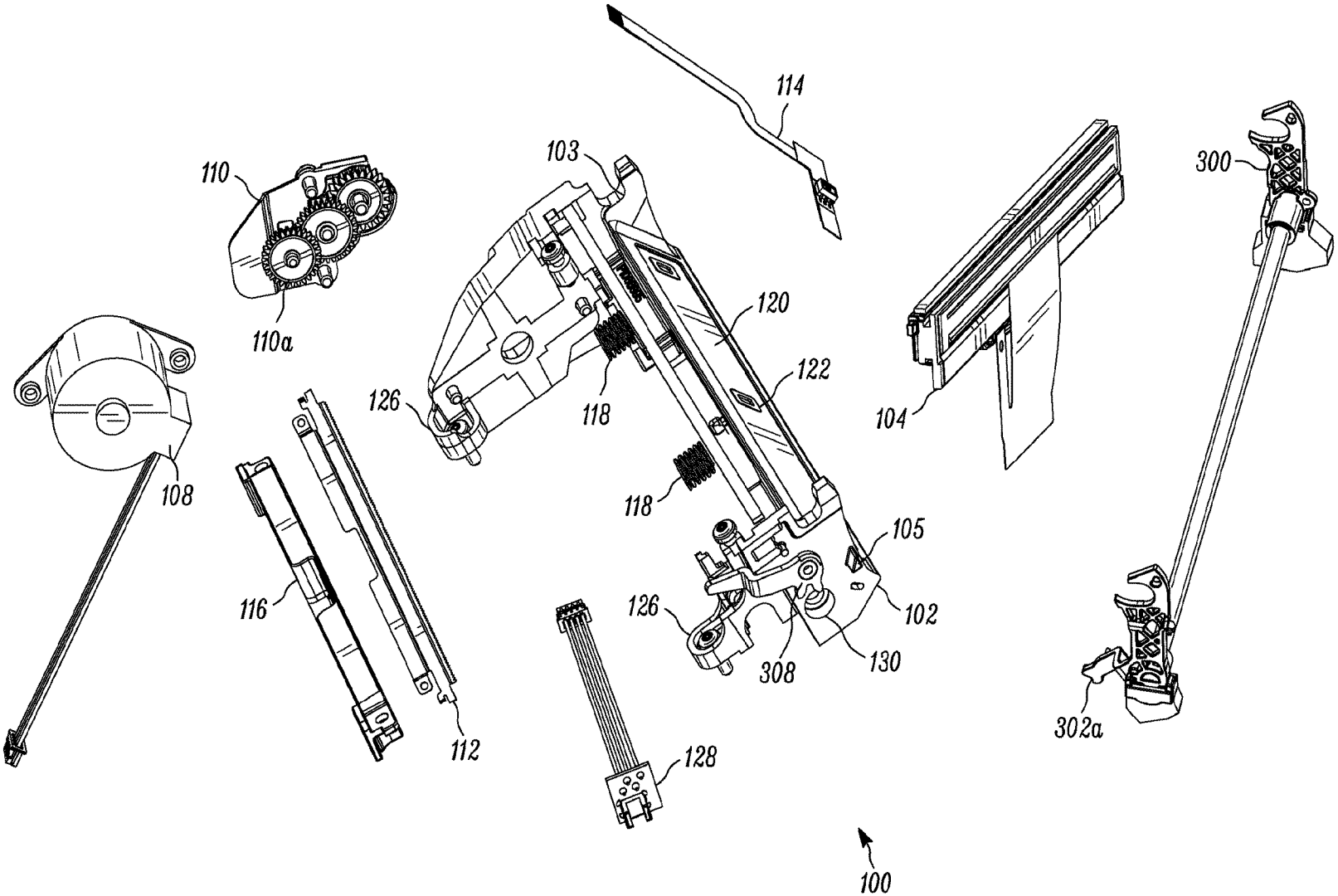
FIG. 2A illustrates an exploded view of an example modular print drive assembly in accordance with an example embodiment of the present invention

FIG. 2A illustrates an exploded view of an example modular print drive assembly 100 in accordance with an example embodiment of the present invention. The modular print drive assembly 100 may include a print drive housing 102, a printhead 104, a platen latch assembly 300, a step motor 108, a print drive gear assembly 110, a tear bar 112, a media sensor 114, a printhead pressure plate 116, a printhead pressure spring 118, a radio frequency antenna 120, printer mount fastener 126, a media lid sensor 128, and a platen latch assembly port 130.

The print drive housing 102 may be connected to the printer by one or more print mount fasteners 126. The print mount fasteners 126 may be screws penetrating printer drive mount apertures, hooks, spring clips, or any other retention device. The print drive housing may define platen assembly recesses 103 which are configured to provide support and secure the platen assembly 200. The platen assembly recesses 103 may provide support and prevent movement of the platen assembly 200 on an x or y axis, e.g. horizontally toward and away from the print head 104 and vertically toward and away from the print drive assembly 102.

The printhead 104 may be a thermal printhead (e.g., direct thermal printhead, thermal transfer printhead, etc.), laser printhead, inkjet printhead, or the like. The printhead 104 may be connected to the print drive housing using screws, clips, projections and recesses, or other retention devices. The printhead 104 may include an electronic cable and connector, such as a ribbon cable and ribbon connector, configured to supply power and/or control signals to the printhead.

The platen latch assembly 300 may be one or more latch arms pivotally capture a platen shaft 204 of the platen assembly 200, as discussed in FIGS. 10B and 10C. The platen shaft is received in rotatable engagement by two platen latch assembly ports 130 that are defined within the print drive assembly 102. The platen latch assembly 300 may be structured to receive and retain the platen assembly 200 in a position defining a nip between the platen assembly and the printhead 104.

In some embodiments, the platen latch assembly 200 may be configured such that the latch hook 303 of the latch arm 302 and/or second latch arm 306 face the printhead 104 and that the latch arm 302 and second latch arm 306 when actuated to the unlatched position move away from the printhead 104. This may provide tighter contact between the platen roller 202 and the printhead 104. Additionally, actuation of the latch arm 302 and the second latch arm 306 away from the printhead 104 may prevent the latch arm or second latch arm from obstruction by the print drive gear assembly 110.

Figure 2B:
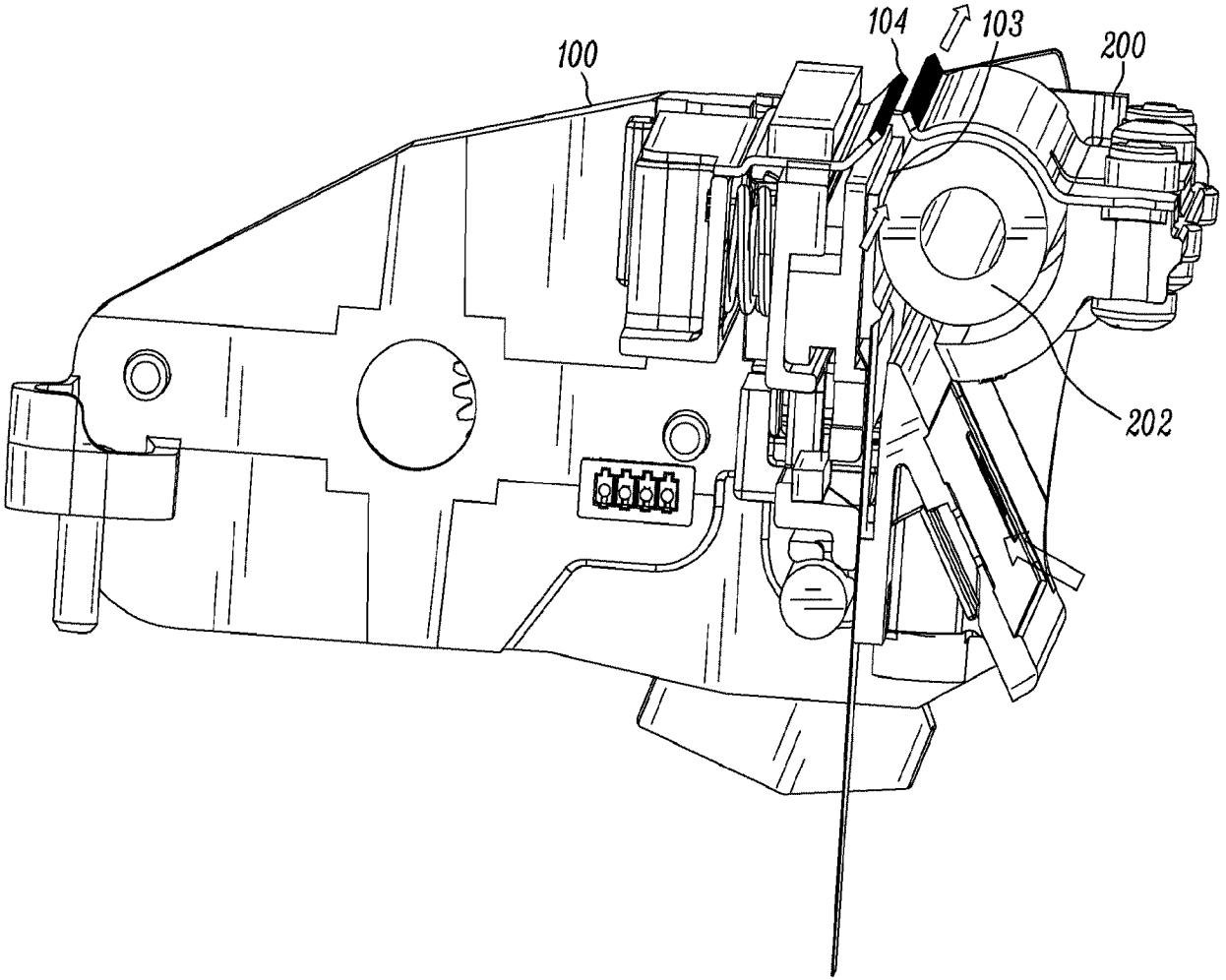
FIG. 2B illustrates a cross-sectional view of the print drive assembly and platen assembly according to an example embodiment of the present invention.

FIG. 2B illustrates a cross-sectional view of the modular print drive assembly 100 and platen assembly 200 according to an example embodiment of the present invention. The illustration includes arrows indicating the path of media 11. The media 11 may pass over the media guide portion of the print drive housing into the nip 103 defined between the printhead 104 and the platen 202. The media 11 may leave the nip 103 at an output of the printhead.

Returning to FIG. 2A, the platen latch assembly 300 may rotate when a latch release lever 302*a* connected to the latch arm 302 is actuated to release the platen assembly 200. The printer drive housing 102 may also include a latch stop 105 configured to mechanically stop the latch arm travel at a platen release position.

In some example embodiments, the platen latch assembly 300 may further include a second latch release lever 308 pivotally connected to the print drive housing 102 and in contact with the latch arm 308, depicted in FIGS. 9-11B. The latch release arm 302*a* and secondary latch release arm 302 may be configured to actuate, e.g., rotate, the latch arm 302 to a unlatch position from opposing directions. For example, the latch release lever 302*a* may be actuated when pressure is applied to the latch release lever in an upward direction, and the second latch release lever 308 may be actuated when pressure is applied in an downward direction. Example platen latch assembly 300 and an alternative latch assembly 400 are discussed in further detail below in FIGS. 9-14C.

The step motor 108 may be connected to the print drive housing using screws, clips, hooks, or other retention devices. The step motor 108 may be coupled to a print drive gear assembly 110. The print drive gears 110*a* of the print drive gear assembly 110 maybe in contact with a drive gear 212 of the platen assembly 200. The step motor 108 may cause the print drive gears 110*a* of the print drive gear assembly to rotate, which may in turn, cause the drive gear 212 and associated platen 202 to rotate.

The platen drive gears 110*a* may have a steel post and relatively wide gear tooth to increase gear life. The wide durable platen drive gears 110*a* are further configured to operate with multiple media types, such as labels, receipts and lineless media.

The tear bar 112 may be connected to the platen drive housing 102 behind the printhead 104 allowing for the printed media to be torn by applying pressure to the media 11 toward the tear bar and printhead.

The printhead pressure plate 116 may be connected to the print drive housing 102 opposite the printhead 104. The printhead pressure plate 116 may provide support for one or more printhead pressure springs 118. The printhead pressure springs 118 may allow the printhead to move forward and backward to apply even pressure to differing types of media, such as labels, receipts, and linerless media. The printhead pressure plate 116 may be constructed of ridged light weight material such as a plastic long glass fiber frame and one or more aluminum brackets.

The media sensor 114 may a magnetic sensor, light sensor, or other sensor configured to detect when media 11 is present in the nip 103. The media sensor 114 may be connected to the print drive housing 102 in a print media guide portion of the print drive housing and may penetrate or be recessed within a media sensor port 122. In some embodiments, the modular print drive assembly 100 may a plurality of media sensors 114 which may each penetrate or be recesses in a plurality of media sensor ports 122, such as at the center and each side of the media guide portion of the print drive housing 102.

The radio frequency antenna 120 may be connected to the print media guide portion of the print drive housing 102. The radio frequency antenna 120 may be a Bluetooth low energy, near field communication, radio frequency identification, WiFi, or other radio frequency technology. The radio frequency antenna 120 may be a coupler antenna laid out on a flex circuit with an adhesive back. The radio frequency antenna 120 may be adhesively affixed to the print drive housing 102. In some embodiments, the radio frequency antenna 120 may be a thin printed circuit board including an antenna circuit.

The media lid sensor 128 may be connected to the print drive housing 102 in a location which the media lid may cover the media lid sensor when the media lid is closed, such as the side of the print drive housing. The media lid sensor 128 may be a magnetic sensor, light sensor, mechanical switch, or the like. In an example embodiment, a projection on the latch arm 302 may mechanically actuate the media lid sensor 128, in an instance in which the media lid is closed.

Figure 3:
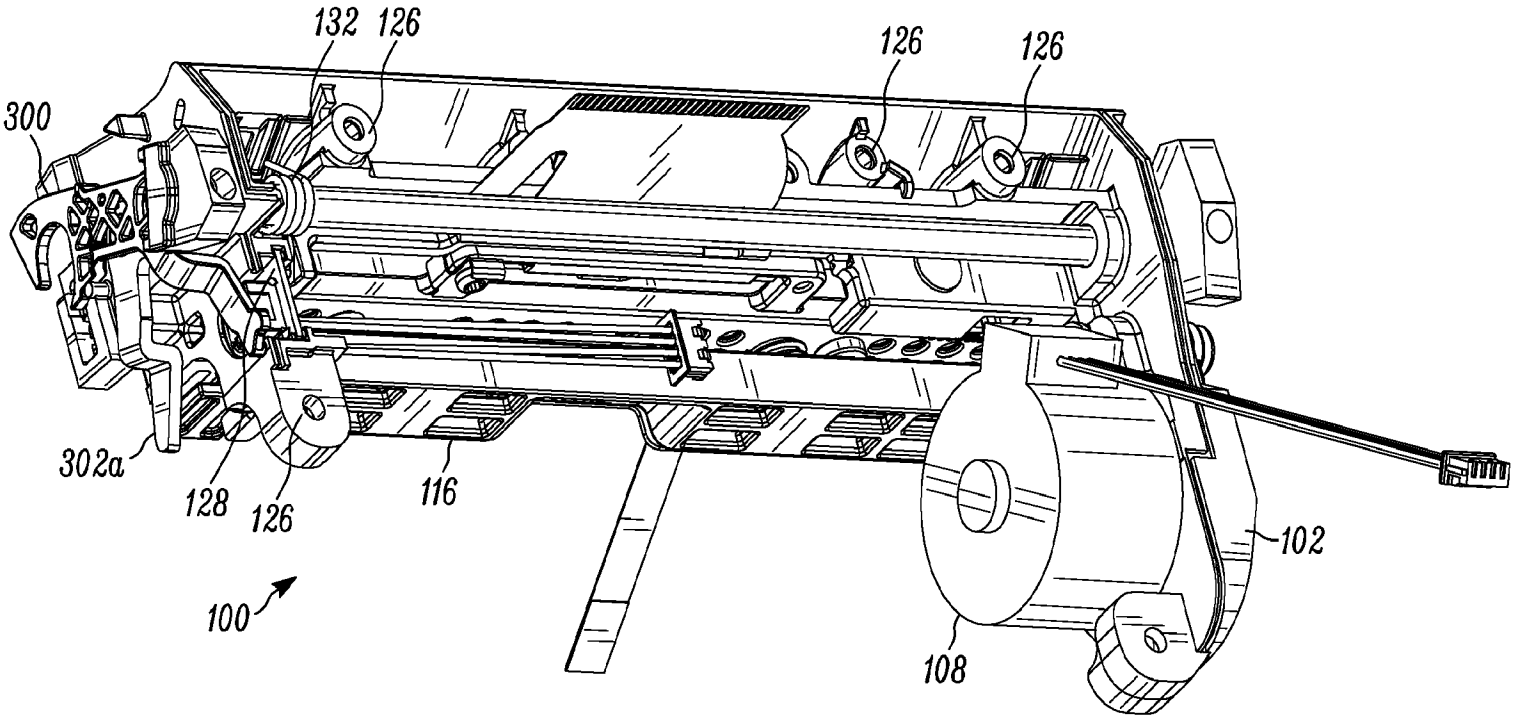
FIG. 3 illustrates a bottom perspective view of an assembled modular print drive assembly in accordance with an example embodiment of the invention.

FIG. 3 illustrates a bottom perspective view of an assembled modular print drive assembly in accordance with an example embodiment of the invention. The step motor 108 is connected to a side of the print drive housing 102. The print drive housing 102 includes two print mount fasteners 126, which in this example are print mount apertures configured to receive a screw or pin to connect the modular print drive assembly to the printer without disassembly of the modular print drive assembly.

The print drive assembly 102 also includes a platen latch assembly return spring 132 connected at one end to the platen latch shaft 304 and at the other end to the print drive housing 102. The platen latch assembly return spring 132 applies pressure to the platen shaft, and in turn bias the one or more latch arms toward a latched position. Alternatively, the return spring may be coupled to a latch arm.

The second latch release lever 308 is pivotally connected to the print drive housing 102 and is in contact with the platen latch assembly 300. The printhead pressure plate 116 is connected to the print drive housing 102 opposite the printhead 104. The media sensor 128 penetrates the print drive housing 102 opposite the step motor 108.

Figure 4:
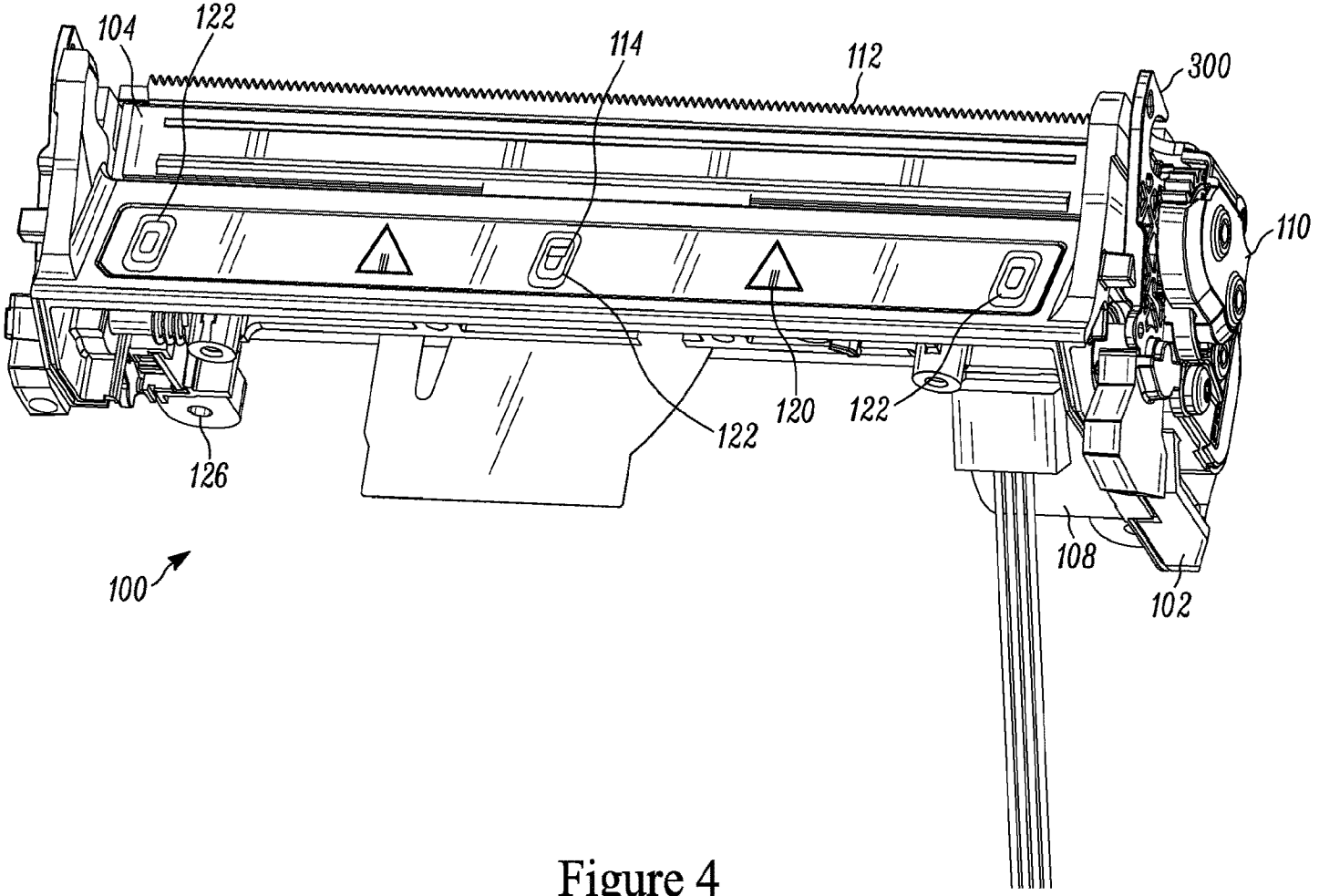
FIG. 4 illustrates a front perspective view of an assembled modular print drive assembly in accordance with an example embodiment of the invention.

FIG. 4 illustrates a front perspective view of an assembled modular print drive assembly 100 in accordance with an example embodiment of the invention. The step motor 108 is connected to the print drive housing 102 opposite the print drive gear assembly 110. The print media guide portion of the print drive housing 102 includes a plurality of media sensor ports 122. A media sensor 114 penetrates the center of one or more media ports 122. The radio frequency antenna 120 is affixed, e.g. by adhesive, tabs, barbs, or the like, to the print media guide portion of the print drive assembly 102. The radio frequency antenna 120 further includes a plurality of apertures aligned with media sensor ports 122. The tear bar 112 is connected, e.g. by fasteners, tabs, clips, or the like, to the print drive housing at the output of the printhead 104. The output of the printhead may be the area at which printed media exits the print head printing area.

Figure 5:
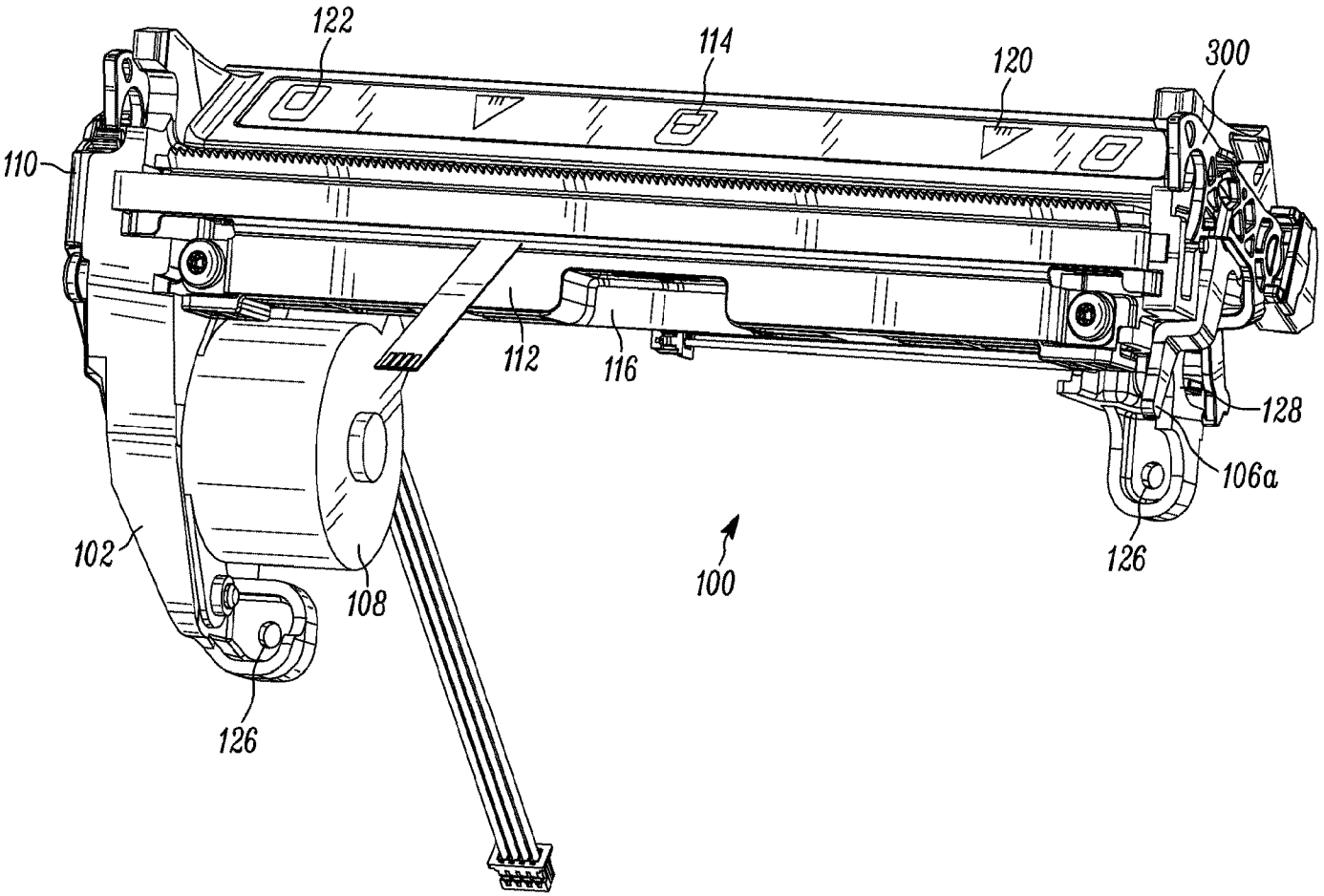
FIG. 5 illustrates a top perspective view of an assembled modular print drive assembly in accordance with an example embodiment of the invention.

FIG. 5 illustrates a top perspective view of an assembled modular print drive assembly 100 in accordance with an example embodiment of the invention. The printer mount fasteners 126 of the print drive housing 102 are positioned to be accessed without disassembly of the modular print drive assembly 100. For example, the step motor 108 is connected, e.g. by fasteners, clips, barbs, or the like, to the print drive housing 102 forward of the printer mount fastener 126, and therefore would not have to be removed to access the printer mount fastener.

Exemplary Modular Platen Assembly

Figure 6A:
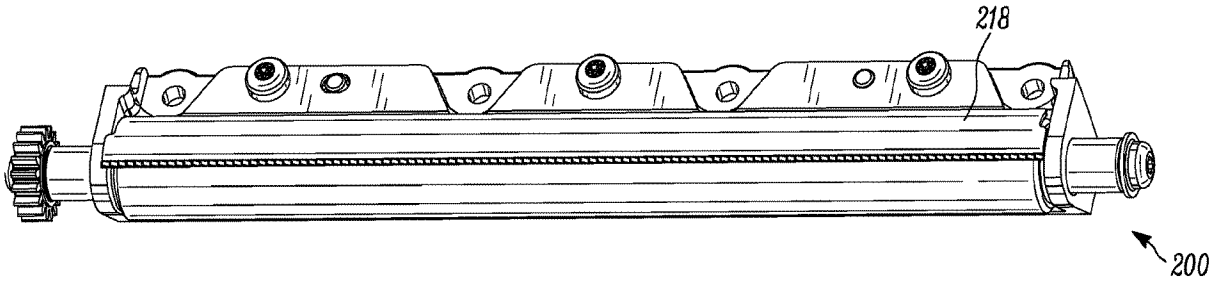
FIGS. 6A and 6B illustrate perspective views of a modular platen assembly in accordance with an example embodiment of the present invention.
Figure 6B:
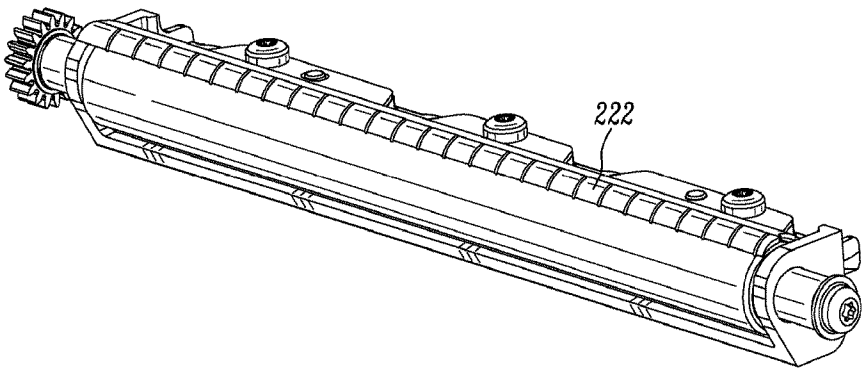

FIGS. 6A and 6B illustrate perspective views of a modular platen assembly 200 in accordance with an example embodiment of the present invention. FIG. 6A illustrates a modular platen assembly 200 which includes a tear bar 218. FIG. 6B illustrates a platen assembly 200 which includes a platen scrapper 222.

Figure 7:
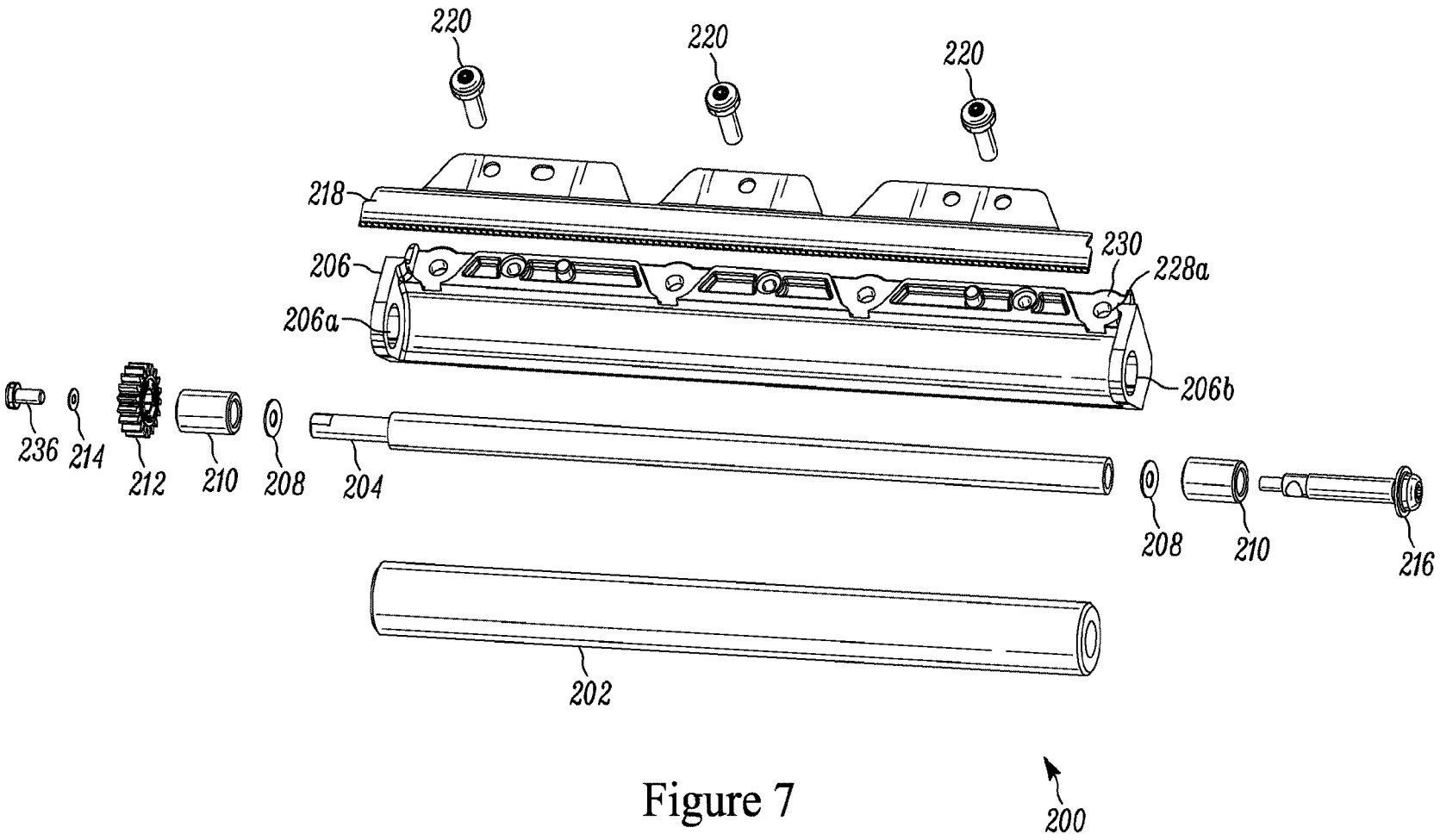
FIG. 7 illustrates an exploded view of a modular platen assembly in accordance with an example embodiment of the present invention.

FIG. 7 illustrates an exploded view of a modular platen assembly 200 in accordance with an example embodiment of the present invention. The modular platen assembly 200 may include a platen roller 202, a platen shaft 204, a platen housing 206, platen washers 208, platen bearings 210, a drive gear 212, drive gear washer 214, shaft journal 216, tear bar 218, and 220 tear bar retention fasteners, and drive gear retention screw 236.

The platen housing 206 may include a first and second platen shaft aperture 206*a* and 206*b*. The platen may include a platen roller 202 disposed around a platen shaft 204. The platen shaft 204 may rotatably engage a first platen shaft bearing 210. A platen washer 208 may be disposed between the platen roller 202 and platen shaft 204 to prevent friction between the platen bearing and platen shaft. The platen shaft bearing 210 may be positioned within the first platen shaft aperture 206*a*. The drive gear 212 may be connected to the platen shaft at a drive end opposite the platen and exterior to the platen housing 206 utilizing the drive gear retention screw 236 and drive gear washer 214, or other retention devices.

In some example embodiments, such as the platen assembly 200 which includes a platen scrapper 222, the platen roller 202 may be constructed of a non-stick material or have a non-stick coating. The platen assembly 200 with non-stick platen roller 202 and scrapper 222 may be used for linerless media, such as linerless labels with adhesive backing.

The platen shaft 204 may have a longitudinal axis and connect, e.g. by threads, clips, barbs, friction, or the like, at a retention end to a shaft journal 216 at the same longitudinal axis. The shaft journal 216 may be a removable extension of the platen shaft 216. The shaft journal 216 may rotatably engage the second platen bearing 210. The second platen bearing 210 may be positioned within the second platen housing aperture 206*b*. The platen housing apertures 206*a/b* may fully encompass the circumference of the platen bearing, preventing inadvertent ejection of the platen, such as by an impact and may be more resistant to fracture or cracking than a clamp or clip which does not fully encompass the circumference of the platen bearing.

The tear bar 218 may be connected to the platen housing 206 using one or more tear bar fasteners 220, e.g. screws, clips, or other retention quarter turn fasteners, or the like. The tear bar 220 may be configured to tear a print media when pressure is applied to the print media against the tear bar.

The platen housing 206 may also include a substantially planer mounting flange 230 including mounting apertures 228*a*.

Figure 8A:
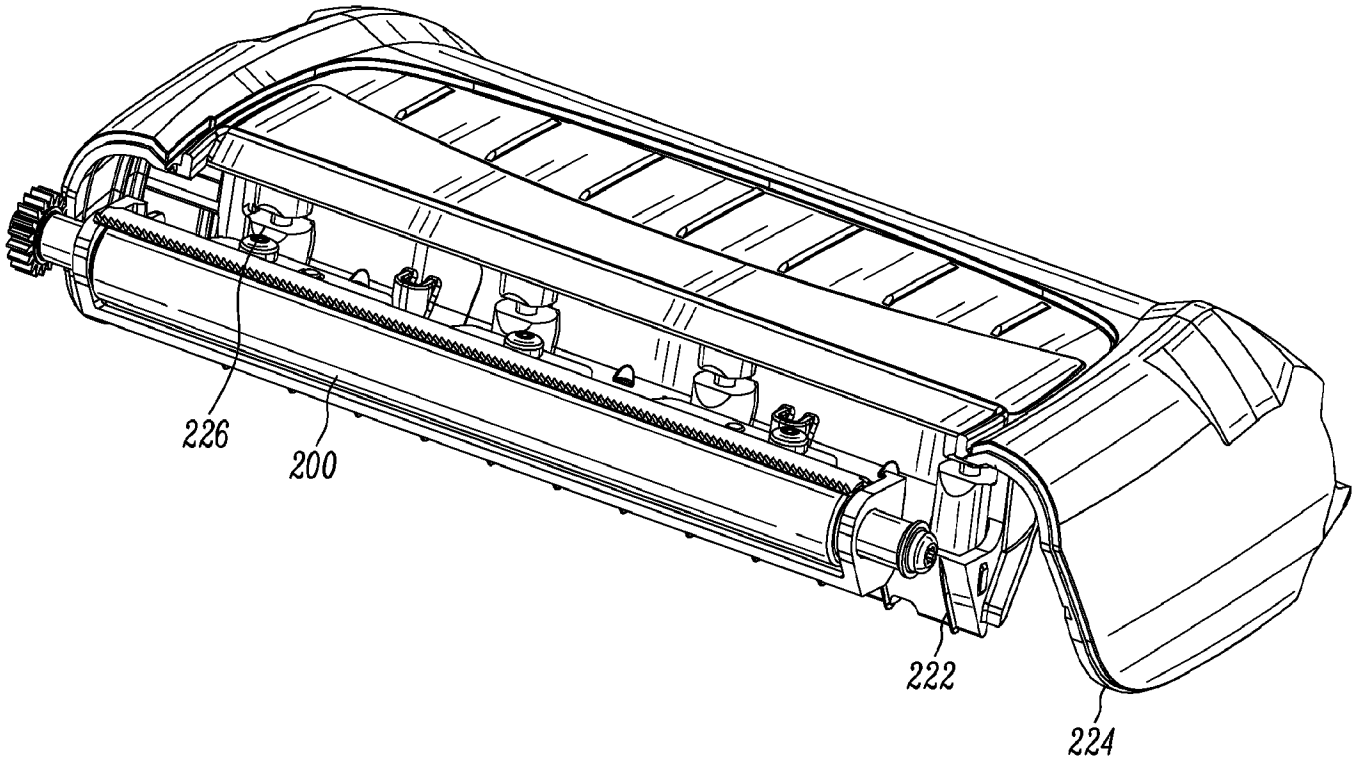
FIG. 8A illustrates a top perspective view of an assembled modular platen assembly and media lid in accordance with an example embodiment of the invention.

FIG. 8A illustrates a top perspective view of an assembled modular platen assembly and media lid in accordance with an example embodiment of the invention. The modular platen assembly 200 may be configured to such that the mounting flange 230 aligns with a mounting flange 226 of the media lid 224. The mounting flange 226 of the media lid may also align with a mounting flange 226 of a media guide 222. The modular platen assembly may be slidably received between the media lid 224 and the media guide 222.

Figure 8B:
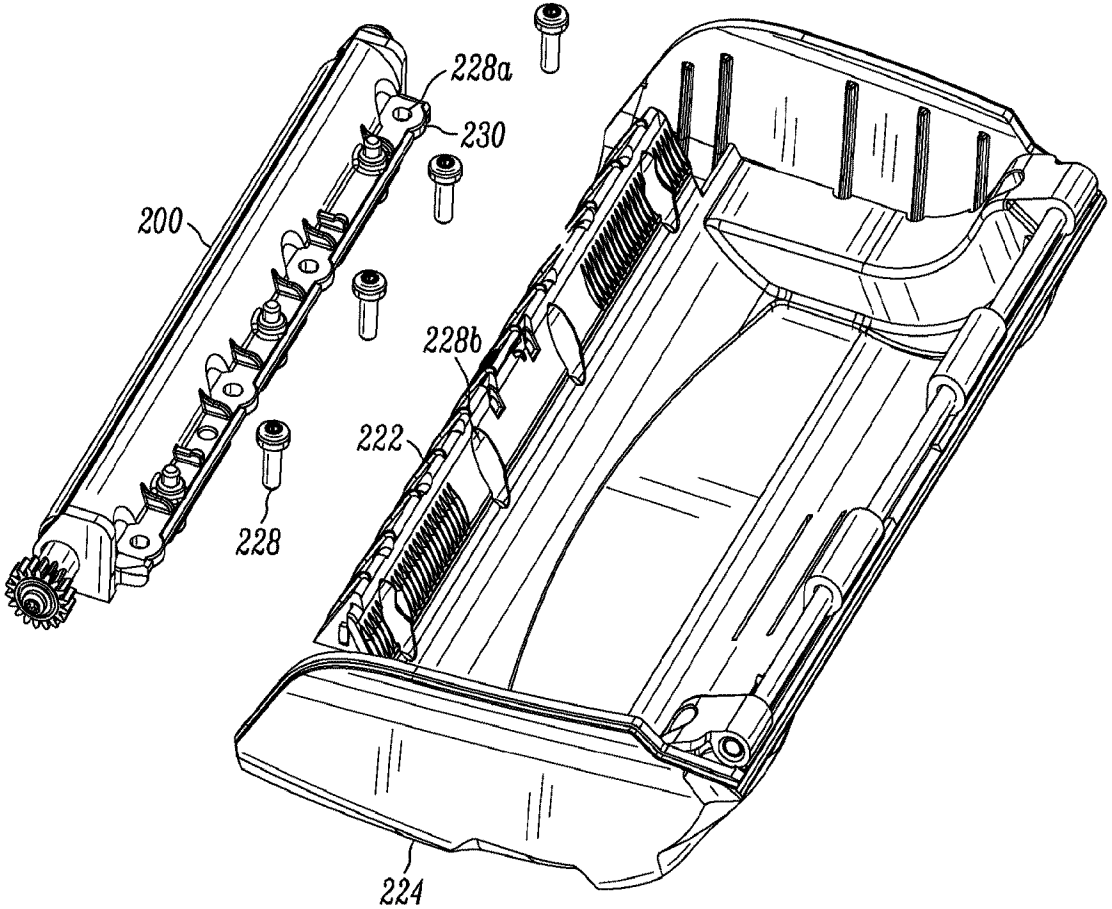
FIG. 8B illustrates a bottom perspective view of an assembled modular platen assembly and media lid in accordance with an example embodiment of the invention.

FIG. 8B illustrates a bottom perspective view of an assembled modular platen assembly and media lid in accordance with an example embodiment of the invention. The modular platen assembly 200 may be slidably received between the media guide 222 and the media lid 224. The mounting apertures 228*a* of the platen assembly mounting flange 230 may align with the mounting apertures 228*b* of the mounting flange 226 of the media lid 224 and media guide 222. The platen assembly 200 may be retained by one or more platen retention fasteners 228, e.g. screws, clips, quarter turn fasteners, or the like, which penetrate the mounting apertures 228*a* of the of the platen assembly mounting flange 230 and the mounting apertures 228*b* of the mounting flange 226 of the media lid 224 and media guide 222.

Figure 8C:
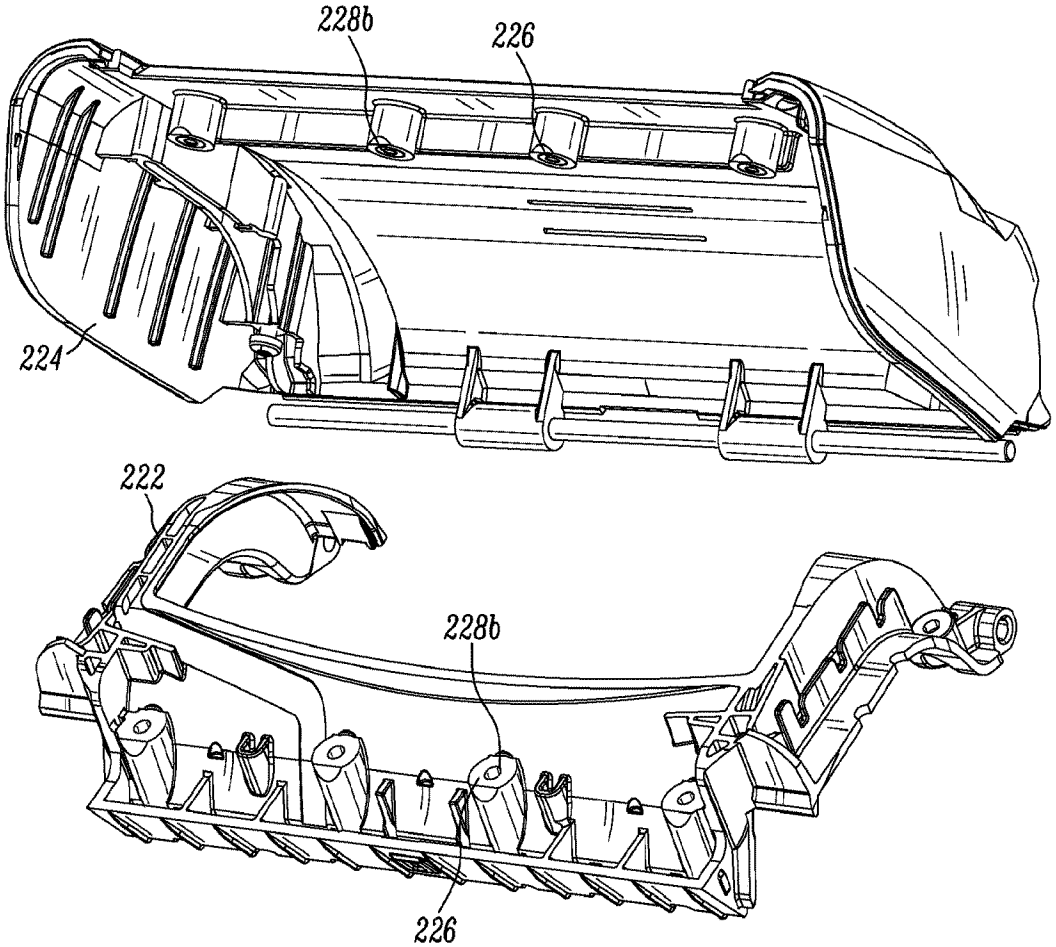
FIG. 8C illustrates as exploded view of media lid and media guide in accordance with an example embodiment of the invention.

FIG. 8C illustrates as exploded view of media lid and media guide in accordance with an example embodiment of the invention. The media guide 222 may be connected to the media lid 224 by fasteners, such as screws, clips, barbs, or the like.

Exemplary Weighted Latch Assembly

Figure 9:
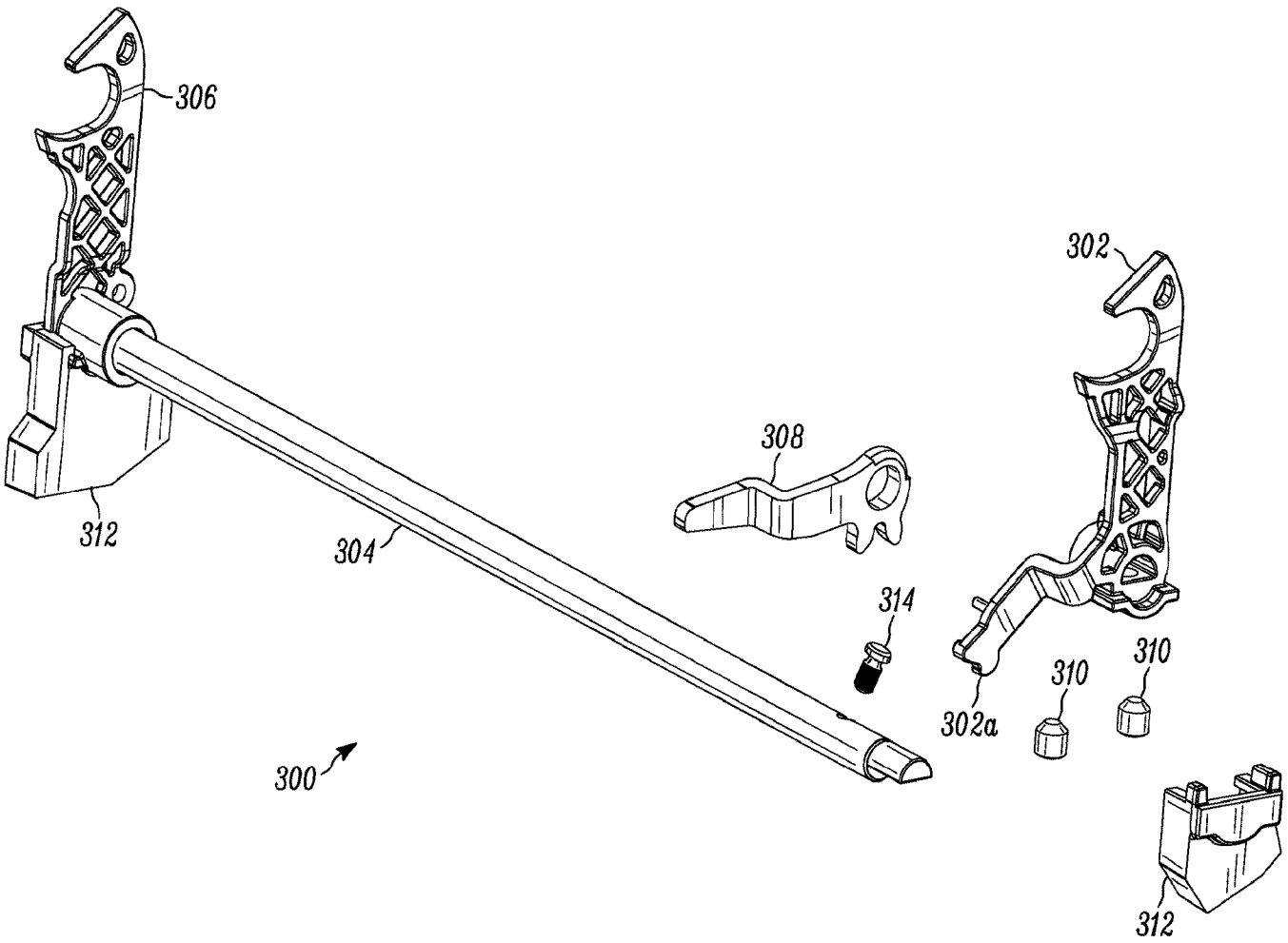
FIG. 9 illustrates an exploded view of an exemplary weighted latch assembly in accordance with an example embodiment of the present invention.

FIG. 9 illustrates an exploded view of an exemplary weighted latch assembly 300 in accordance with an example embodiment of the present invention. The weighted latch assembly 300 may include a latch arm 302, a latch release lever 302*a*, a latch shaft 304, a second latch arm 306, a second latch release lever 308, and latch arm weight 312.

The latch arm 302 may include a latch hook 303 configured to retain the platen assembly 200. The latch hook 303 may be configured to retain the platen assembly by encompassing at least a portion of the platen shaft 204 or platen bearings 210, as described in FIG. 7 above and FIGS. 10B and 10C below.

The latch arm 302 may also have a shaft receiver 320 at a pivot end. In an example embodiment the shaft receiver 320 may have a semi-circular aperture and the latch shaft 304 may include a semi-circular projection which penetrates the shaft receiver. The latch shaft 304 may be connected to the latch arm 302 using a fastener, such as a set screw, clip, or the like. The second latch arm 306 may be connected to a second end of the latch shaft 304.

The latch arm 302 may include or be connected to a latch release lever 302*a* which extends from the latch arm between the latch hook 303 and the pivot end. The latch release lever 302*a* may be configured to rotate the latch arm 302 from a latched to an unlatched position when actuated. The latch release lever 302*a* may be actuated by applying pressure toward the latch arm 302 away from the latched position, e.g. upward.

The second latch release lever 308 may be in contact with the latch arm 302. The second latch release lever 308 may be configured to rotate the latch arm from a latched to an unlatched position when actuated from a direction opposite the latch release arm 302*a*. For example, the second latch release lever may be actuated by applying pressure to the second latch release lever in a downward direction, which in turn may cause the second latch release lever to apply pressure to the latch arm 302 rotating the latch arm to an unlatched position. Further detail of the operation of the second latch release arm is discussed below in FIGS. 11A and 11B.

The return spring mount 314 may be connected to the latch shaft 304, such as be screw threads. The return spring mount 314 may be connected to a return spring, such as platen latch return spring 132 of FIG. 3. The return spring 132 may bias the latch arm 302 and second latch arm 306 toward a latched position. Additionally or alternatively, the return spring mount may be connected to the latch arm 302 or second latch arm 306.

The latch arm weight 312 may be connected to the latch arm 302 and/or second latch arm 306. The latch arm weight 312 may be additional material added to the latch arm 302 and/or second latch arm 306 or may be separate weights. The latch arm weight 312 may be lead shot, steel, tungsten or other suitably heavy material. The latch arm weight 312 may be connected to the latch arm 302 or second latch arm 306 at the pivot end opposite the latch hook 303 by a retention element, such as setscrews 310, clips, barbs, or the like. The latch arm weight 312 may provide a counter force to gravity or impact acting on the latch arm 302 or second latch arm 306 and provide additional bias toward the latch position in addition to the return spring 132. Additionally, the latch weight 312 may balance the weight distribution of the latch arm 302 or second latch arm 306 at a pivot end, e.g. the shaft receiver 320. FIG. 10D illustrates a gravitational or impact force G applied such that the latch arm weights 310 are biased toward the latch position. Additionally, the gravitational force G is applied to both the latch hook 303 end of the latch arm 302 and the latch weight 312, which may prevent the impact or gravity from shifting the latch arm 302 to the unlatched position.

In some embodiments, the latch arm weight 312 may be retained in a weight housing. The weight housing may retain the latch arm weights by enclosing the latch arm weight 312 within the weight housing, compressive retention to the sides of the weights, or other retention means. The weight housing may be connected to the latch arm 302 and/or the second latch arm at the pivot end opposite the latch hook 303.

FIG. 10 illustrates a perspective view of an assembled exemplary weighted latch assembly in accordance with an example embodiment of the present invention. FIG. 10B depicts the latch arm 302 in a latched position engaging the platen assembly 200, platen shaft 204, shaft journal 216, and/or platen bearing 210. The latch assembly being pilotable at the pivot end including the shaft receiver 320. In FIG. 10C, the latch release lever 302*a* has been actuated, e.g. a pressure P1 has been applied in the upward direction toward the latch hook 303 of the latch arm 302 driving the latch arm, in the direction D1, to an unlatched position, disengaging the platen assembly 200. Additionally, latch hook projection 303*a* mechanically lifts or ejects the platen assembly 200 in direction D1*a* to open the media lid 424. FIG. 11A illustrates an exploded view of the latch arm and the second release lever in accordance with an example embodiment of the present invention. The second latch release lever 308 may include at least one release drive projection 316 configured to engage at least one release projection 318 or release aperture (not shown). In an instance in which the second latch release leaver 308 is actuated, such as by applying a downward pressure, the release drive projection 316 may rotate with the second latch release lever, applying pressure to the release projection 318 driving the latch arm 302 from a latched to an unlatched position.

In an example embodiment, the latch arm 302 and/or second latch arm 306 may include one or more weight reduction cavities 314 between the latch hook 306 and the pivot end. The weight reduction cavities 314 may be depressions, holes, lattice structure, web like structure, or the like, which may reduce the total material of the latch arm 302 and/or second latch arm 306.

FIG. 11B illustrates exemplary operation of a platen latch assembly 300 according to an example embodiment of the present invention. The latch release lever 302*a* and/or the second latch release lever 308 may be actuated by applying pressure. As indicated by the arrows, the latch release lever 302*a* may be actuated by applying an upward pressure P2 toward the open end of the latch hook 303, driving the latch arm in direction D2 to the unlatched position, by rotation about the pivot, e.g. shaft receiver 320. In an instance in which the second latch lever 308 is actuated, as indicated by the arrows, pressure P3 may be applied downward to the second latch release lever. The second latch release lever 308 may pivot driving at least one release drive projection 316. The at least one release drive projection 316 may rotate in direction R1 apply pressure to the release projection 318 of the latch arm 302, which rotates in direction R2, driving the latch arm 302 from a latched to an unlatched position.

Exemplary Locking Platen Latch Assembly

FIG. 12 illustrates a front perspective view of a locking platen latch assembly 400 in accordance with some example embodiments of the present invention. In an alternative embodiment the latch assembly 300, as discussed above may be replaced with the locking platen assembly 400, as discussed below. The locking platen latch assembly 400 may include a latch arm 402 and a lock arm 404. The latch arm 420 may define a latch hook 406 at a latch end and a pivot 408 at a pivot end. In some embodiments, the locking platen latch assembly 400 may also include a latch shaft 304 and second latch arm 306 as discussed above in FIGS. 9 and 10A. The lock arm 404 may be slidably coupled to the latch arm 402 and translate between a locked position and an unlocked position. The lock arm 404 may include a lock bar 416 at a lock end opposite a pivot end. The lock bar 416 configured to close, e.g. lock the latch hook 406 onto and around the platen shaft 204, shaft journal 216, or platen bearing 210 of a platen assembly.

The latch arm 402 or lock arm 404 may include a may include an aperture 410 to receive a guide 412. In the example depicted, the lock arm 404 includes a lock arm aperture 410 and the latch arm includes a plurality of lock arm guides 412. The lock arm guide 412 may maintain the alignment of the lock arm 404 relative the latch arm 402. The lock arm 404 or latch arm 402 may also include a capture, such as a guide head extending from the guide over the aperture edges, or a projection from the latch arm or lock arm which extends around the edge of the opposite arm to maintain the coupling of the latch arm to the lock arm.

The latch arm 402 may include a tension mount 414 disposed between the latch hook 406 and pivot 408. The lock arm 404 may include a tension mount 416 disposed at the pivot end. The tension mechanism 418, such as a spring, elastic band, or the like, may be connected between the latch arm tension mount 414 and the lock arm tension mount 416. The tension mechanism 418 may bias the lock arm 404 toward a locked position.

The lock arm 404 may include or be connected to a lock cam 420, which extends from the lock arm. The lock cam 420 may move the lock arm 404 to an unlocked position in response to operation of the lock cam. For example, pressure may be applied to the lock cam 420 in the direction of the pivot end, the lock arm 404 may slide from a locked to an unlocked position in response to the pressure applied to the lock cam.

The latch arm 402 may include or be connected to a latch cam 422, which extends from the latch arm. The latch cam 422 may move the latch arm 402 to an open position in response to operation of the latch cam. For example, the pressure may be applied to the latch cam 422 in the direction of the closed end of the latch hook 406, the latch arm 402 may rotate about the pivot from a latched to an unlatched position in response to the pressure applied to the latch cam. The movement of the latch arm 402 from the latched to the unlatched position may cause the latch hook 406 to disengage from the platen shaft 204 of the platen assembly 200.

FIGS. 13A-C illustrate a front perspective view and operation of a locking platen latch assembly 400 in accordance with some example embodiments of the present invention. The locking platen latch assembly 400 may also include a cam actuator 424. The cam actuator 424 may be configured to drive the lock arm 404 between the locked and unlocked position and further structured to drive the latch arm 402 from a latched position to an unlatched position. The cam actuator 424 may be configured to cause the operation of the lock cam 420 prior to operating the latch cam 422 in response to actuation of the cam actuator.

In an example embodiment, the cam actuator 424 may be a slide and track (not shown), the slide may operate by traveling the track and operating the lock cam 420 and then operating the latch cam 422. In some example embodiments, the cam actuator 424 may be rotated about an axis. In some example embodiments, the cam actuator 424 may be a rack 424*a* and pinion 424*b* actuator.

The cam actuator 424 may include a lock operating projection 426 and a latch operating projection 428. In the depicted examples of FIGS. 13A-C, the cam actuator 424 is substantially circular and rotates about a central axis. The cam actuator 424 includes a lock operating projection 426 and a latch operating projection 428, configured such that when the cam actuator is rotated the lock operating cam operates the lock cam 420 prior to the latch operating projection operating the latch cam 422.

In FIG. 13A the locking platen latch assembly 400 is in the locked and latched position. Specifically, the latch arm 402 is in the latch position and the lock arm is in the latch position. The lock operating projection 426, of the cam actuator 424 is near or in contact with the lock cam 422 and the latch operating projection 428 is relatively distant from the latch cam 422. In FIG. 13B, the cam actuator 424 has been actuated by rotation R3 to a first position. The lock operating projection 426 has applied pressure to the lock cam 420 toward the pivot end of the lock arm 404. The lock arm 404 has been driven, in direction D4, into the unlocked position, in response to the pressure applied to the lock cam 420. In FIG. 13C, the cam actuator 424 has by rotation R4 to a second position. The lock operating projection 426 maintains pressure on the lock cam 420, thereby maintaining the lock arm 404 in the unlocked position. The latch operating projection 428 has applied pressure to the latch cam 422 toward the closed end of the latch hook 406. The latch arm 402 has been driven, indirection D5, to an unlatched position in response to the pressure applied to the latch cam 422.

FIG. 13D illustrates a rear perspective view and operation of a locking platen latch assembly 400 in accordance with some example embodiments of the present invention. The cam actuator 424 may include a rack 424*a* and pinion 424*b*. The pinion 424*b* may include a lock operating projection 426 and latch operating projection 428. The rack 424*a* may include a linear gear 434 and the pinion 424*b* may include a pinion gear 435. The pinion gear 435 may be curved, such that the pinion 424*b* rotates about an axis A when actuated.

In an instance in which the cam actuator 424 is actuated, the rack 424*a* may move in direction D6, thereby translating the linear motion of the linear gear 434 to rotational motion of the pinion gear 434 causing the pinion 424*b* to rotate in direction D7. As the pinion 424*b* rotates in direction D7, the lock operating projection 426 applies pressure in direction D8 to the lock cam 422 causing the lock arm 404 to be driven in the direction D9 to an unlocked position. As the pinion 424*b* continues to rotate in direction D7, the latch operating projection 428 applies pressure to the latch cam 422 in the direction D10 causing the latch arm 402 to be driven in the direction D11 to an unlatched position.

FIGS. 14A and 14B illustrate an example platen latch release buttons in accordance with an example embodiment of the present invention. The mobile printer may include a printer casing 430 and a platen latch release button 432. The platen release button may be configured to release the modular platen assembly 200 from a platen latch assembly, such as platen latch assembly 300 or 400 as described in FIGS. 9-13C. The platen latch release button 432 may have a finger depression or catch configured to present a gripable surface for a user to depress to actuate the platen latch release button. The platen latch release button 432 may include a projection which may apply pressure to the latch release lever 302*a* or a second latch release lever 308. In some example embodiments, the platen latch release lever 432 or cam actuator 424 may include an aperture configured to receive or accept a cam actuation projection of the opposite of the release platen latch release lever or cam actuator. The cam actuation projection may apply or receive pressure from the cam actuation aperture, in an instance in which the platen latch release button is depressed, causing the cam actuator to operate the locking latch assembly 400 as described in FIG. 13A-C. In an example embodiment, the platen release button 432 may be the rack 424*a* or be connected to the rack, as described in FIG. 13D.

The platen latch release button 432 of FIG. 14A is configured to be depressed, e.g. slide, along a longitudinal axis of the printer casing 430. The platen latch release button depicted in FIG. 14B is configured to be depressed along a latitudinal axis of the printer casing 430.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A platen assembly comprising:

a platen housing defining a first platen shaft aperture proximate a first end a second platen shaft aperture proximate a second end;

a platen structured to be rotatably received within the first platen shaft aperture and the second platen shaft aperture, the platen defining a drive end and a retention end, wherein the platen further comprises:

a platen shaft having an opening at the retention end of the platen shaft, the opening configured to removably receive a shaft journal;

a first shaft bearing disposed proximate the drive end of the platen and within the first platen shaft aperture, a drive gear disposed proximate the drive end of the platen and the first shaft bearing, and a second shaft bearing disposed proximate the retention end of the platen and within the second platen shaft aperture.

2. The platen assembly of claim 1, wherein the platen comprises a platen roller, and the platen shaft is disposed in the platen roller.

3. The platen assembly of claim 1, wherein the shaft journal, when inserted into the opening of the platen shaft, rotatably engages the second shaft bearing.

4. The platen assembly of claim 1, wherein the platen shaft has a longitudinal axis, and wherein shaft journal is inserted into the platen shaft at the same longitudinal axis as the platen shaft.

5. The platen assembly of claim 1, wherein the drive gear and the shaft journal are removably connected to allow removal of the platen.

6. The platen assembly of claim 1 further comprising:

a tear bar connected to the platen housing configured to tear print media when pressure is applied to the print media against the tear bar.

7. The platen assembly of claim 1, wherein:

the platen comprises a non-stick platen roller; and the platen assembly further comprises a platen scrapper.

8. The platen assembly of claim 1, wherein the platen housing further comprises a first mounting flange configured to align with a second mounting flange of a printer media access lid.

9. The platen assembly of claim 1, wherein the shaft journal retains the platen shaft in the platen housing.

* * * * *